US007389061B2

(12) United States Patent
Yamaki et al.

(10) Patent No.: US 7,389,061 B2
(45) Date of Patent: Jun. 17, 2008

(54) CLEANING DEVICE AND IMAGE FORMING APPARATUS HAVING A CLEANING BRUSH AND A COLLECTION ROLLER THAT MOVE IN THE SAME DIRECTION AT A CONTACT AREA THEREBETWEEN

(75) Inventors: Hideo Yamaki, Toyokawa (JP); Yasunori Nakayama, Aichi-ken (JP); Hidetoshi Noguchi, Aichi-ken (JP); Satoru Shibuya, Aichi-ken (JP); Tomohide Mori, Okazaki (JP); Yasuo Tanaka, Okazaki (JP); Hideji Higashimura, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 250 days.

(21) Appl. No.: 11/008,630

(22) Filed: Dec. 10, 2004

(65) Prior Publication Data

US 2005/0191069 A1 Sep. 1, 2005

(30) Foreign Application Priority Data

Feb. 27, 2004 (JP) ..... 2004-053844

(51) Int. Cl.
*G03G 15/00* (2006.01)

(52) U.S. Cl. ..... 399/44; 399/353

(58) Field of Classification Search ..... 399/44, 399/353–355

See application file for complete search history.

(56) References Cited

U.S. PATENT DOCUMENTS 4,912,516 A 3/1990 Kaieda
5,517,289 A * 5/1996 Ito et al. ..... 399/149
5,561,513 A 10/1996 Lindblad
5,600,405 A 2/1997 Umeda et al.
5,678,134 A * 10/1997 Miki et al. ..... 399/71
5,845,174 A * 12/1998 Yasui et al. ..... 399/101
7,043,187 B2 * 5/2006 Brown et al. ..... 399/343
7,103,301 B2 * 9/2006 Watanabe et al. ..... 399/159
2003/0039494 A1 * 2/2003 Shakuto et al. ..... 399/357

FOREIGN PATENT DOCUMENTS

JP 2-4911 9/1981
JP 6-70730 7/1987
JP 2-93674 4/1990
JP 7-64444 3/1995
JP 8-335014 12/1996

* cited by examiner

*Primary Examiner*—Vincent Q Nguyen
(74) *Attorney, Agent, or Firm*—Morrison & Foerster LLP

(57) ABSTRACT

A secondary cleaning device has a cleaning brush, collection roller, and controller. The cleaning brush is driven by a drive mechanism and thereby rotates in a state that brush fibers thereof are contacting with a secondary transfer belt to collect toner on the secondary transfer belt. The collection roller is driven by another drive mechanism and thereby rotates in a state contacting with the cleaning brush to collect toner from the cleaning brush. The collection roller rotates in such a manner that the collection roller and the cleaning brush move in the same direction with each other at a contact area between the collection roller and the cleaning brush. The controller controls the drive mechanism such that the circumferential speed ratio of the collection roller with respect to the cleaning brush is greater than one and smaller than two.

22 Claims, 20 Drawing Sheets

PRIOR ART

PRIOR ART

PRIOR ART

CLEANING DEVICE AND IMAGE FORMING APPARATUS HAVING A CLEANING BRUSH AND A COLLECTION ROLLER THAT MOVE IN THE SAME DIRECTION AT A CONTACT AREA THEREBETWEEN

RELATED APPLICATION

This application is based on Japanese Patent Application No. 2004-53844, the contents in which is incorporated herein by reference.

BACKGROUND OF THE INVENTION

The present invention relates to a cleaning device and an image forming apparatus. In particular, the present invention is applicable to a cleaning device provided in an image forming apparatus such as a laser printer, a copying machine, facsimile machine, and multi-function machine of these apparatuses.

An image forming apparatus is provided with a cleaning device for collecting toner remaining on the surface of a photoconductor (e.g., photoconductor drum or photoconductor belt) or an intermediate transfer member (e.g., intermediate transfer belt or intermediate transfer drum) as image bearing bodies after transfer of a toner image.

As shown in FIG. 18, a cleaning device is known that comprises: a cleaning brush 2 rotating with contacting to an image bearing body 1, a collection roller 3 rotating with contacting to the cleaning brush 2, and a scraper 4 being fixed and contacting to the collection roller 3. The cleaning brush 2 is provided with a large number of hairs or brush fibers 2*b* implanted in an outer periphery of a core metal 2*a*. Toner 5 on a surface of the image bearing body 1 is mechanically scraped by the brush fibers 2*b* of the cleaning brush 2. A bias voltage of a polarity reverse to a charging polarity for the toner 5 is applied to the cleaning brush 2. For example, when a normal charging polarity of the toner 5 is negative, the bias voltage of positive polarity is applied to the cleaning brush 2. This bias voltage generates an electric field between the cleaning brush 2 and the image bearing body 1, so that the toner 5 is electrostatically adsorbed to the cleaning brush 2. The toner 5 collected by the cleaning brush 2 moves to the collection roller 3 owing to a potential difference between the cleaning brush 2 and the collection roller 3. The toner 5 on the surface of the collection roller 3 is mechanically scraped by the scraper 4.

A rotational direction (arrow A1) of the collection roller 3 and a rotational direction (arrow A2) of the cleaning brush 2 are set so that the collection roller 3 and the cleaning brush 2 move in the reverse directions to each other at a contact area between them. In FIG. 18, both of the collection roller 3 and the cleaning brush 2 rotates in the counterclockwise direction, so that they move in the reverse directions to each other at the contact area. In the following description, when a member rotates such that the member moves in a reverse direction relative to a reference member at a contact area between them, the rotational direction is referred to as a "reverse direction." The rotation of the cleaning brush 2 (arrow A2) is in the reverse direction relative to the revolution of the image bearing body 1 (arrow A3). U.S. Pat. No. 5,600,405 discloses this type of cleaning device.

Each brush fiber 2*b* of the cleaning brush 2 receives forces in the same direction at the contact area between the cleaning brush 2 and the image bearing body 1 and at the contact area between the cleaning brush 2 and the collection roller 3. Thus, in a latter portion of the brush life, the brush fibers 2*b* curl or incline, causing decrease of the outer diameter of the cleaning brush 2 as shown in FIG. 19. This reduces the amount of nip of the cleaning brush 2 against the image bearing body 1 and the collection roller 3, and thereby reduces a cleaning performance. Further, even in the state that an operation of the cleaning brush 2 is stopped, the cleaning brush 2 keeps contacting with the image bearing body 1 and the collection roller 3. Thus, when a period during which the cleaning brush 2 is stopped continues for a prolonged time, the brush fibers 2*b* of the cleaning brush 2 incline permanently in the portions contacting with the image bearing body 1 and the collection roller 3 in the state of stop of the operation, as shown in FIG. 20. This reduces the cleaning performance.

Another cleaning device is known in which the rotational direction of the collection roller 3 is different from that of FIG. 18. Referring to FIG. 21, the rotational direction of the collection roller 3 (arrow A4) and the rotational direction of the cleaning brush 2 (arrow A2) are set so that the collection roller 3 and the cleaning brush 2 move in the same direction with each other at the contact area between them. In FIG. 21, the collection roller 3 rotates in a clockwise direction, while the cleaning brush 2 rotates in a counterclockwise direction, so that they move in the same direction with each other at the contact area between them. In the following description, when a member rotates such that the member moves in the same direction relative to a reference member at a contact area between them, the rotational direction of is referred to as "forward direction." U.S. Pat. No. 5,561,513, Japan Patent Publication H06-70730, and U.S. Pat. No. 4,912,516 disclose this type of cleaning device. Of these documents, U.S. Pat. No. 5,561,513 discloses that in order to raise inclined brush fibers, a collection roller rotates in the forward direction relative to a cleaning brush, and that a circumferential speed ratio of the collection roller to the cleaning brush is set to be equal to or larger than three. However, when the circumferential speed ratio is set to be equal to or larger than three, a tip of a scraper wears rapidly. This reduces the efficiency of the scraper mechanically removing the toner from the collection roller.

As shown in FIG. 22, a cleaning device is also known that is provided with a pair of collection rollers 3A and 3B and a pair of corresponding scrapers 4A and 4B so as to improve the cleaning performance. One collection roller 3A rotates in the reverse direction relative to a cleaning brush 2 as indicated by an arrow A5, while the other collection roller 3B rotates in the forward direction relative to the cleaning brush 2 as indicated by an arrow A6. Japan Patent Publication H02-4911 discloses this type of cleaning device. However, this approach causes a complexity and a size increase in the device, and hence raises the cost.

As described above, the conventional cleaning devices can not achieve efficient removal of the toner from the image bearing body, prevention of permanent inclination and wear in the brush fibers of the cleaning brush, and a simple configuration.

Further, since the toner is removed mechanically by the cleaning brush, the collection roller, and the scraper, the toner is pulverized and scattered during the cleaning operation in the cleaning device. The pulverized toner accumulates on the surfaces of the image bearing body, the cleaning brush, and the collection roller after the stop of cleaning operation. Thus, when the cleaning device is restarted, the cleaning performance is degraded at an early stage, so that the toner remains on the surface of the image bearing body. The remnant toner causes image noise.

SUMMARY OF THE INVENTION

A first aspect of the invention provides a cleaning device comprising, a cleaning brush for removing toner from an image bearing body provided with a plurality of brush fibers in an outer periphery thereof, and adapted to be rotated in a state that the brush fibers are contacting with the image bearing body, a collection roller for collecting the toner from the cleaning brush adapted to be rotated with contacting to the cleaning brush, and a controller for controlling rotational operations of the cleaning brush and the collection roller so that the collection roller rotates in such a manner that the collection roller and the cleaning brush move in the same direction with each other at a contact area between the collection roller and the cleaning brush, and so that a circumferential speed ratio of the collection roller with respect to the cleaning brush is greater than one and smaller than two.

The rotational direction of the collection roller is in the forward direction relative to the rotation direction of the cleaning brush. This prevents the brush fibers of the cleaning brush from curling or inclining permanently. Thus, this avoids that the permanent inclination in the brush fibers reduces the outer diameter of the cleaning brush so as to degrade the cleaning performance. The circumferential speed ratio of the collection roller to the cleaning brush greater than one and smaller than two achieves efficient removing of the toner from the image bearing body. Further, in the case that a fixed scraper for removing the toner from the collection roller is arranged, wear at a tip of the scraper is suppressed. Thus, according to the first aspect of the present invention, the brush fibers of the cleaning brush is prevented from curling or inclining permanently, and the scraper is protected from tip wear. This permits efficient toner removal from the image bearing body even after the apparatus has been used for a long time. Further, this configuration does not need a plurality of collection rollers, resulting in simple configuration of the cleaning device.

The cleaning device may further comprise a humidity sensor for detecting the humidity in a region encompassing the image bearing body. When the humidity detected by the humidity sensor is equal to or higher than a predetermined threshold humidity, the controller may increase a rotational speed of the collection roller and/or reverse a rotational direction of the collection roller. In case that a recording medium is composed of paper, the recording medium absorbs moisture under a high humidity condition. This reduces the transfer efficiency of a toner image from the image bearing body to the recording medium. For enhancing the transfer efficiency, a transfer voltage needs to be set higher under a high humidity condition. A polarity of the transfer voltage is reverse to a polarity of normal charging of the toner on the image bearing body. Thus, under a high humidity condition, an increasing amount of toner is charged into a polarity reverse to the normal charging polarity. Thus, when the humidity detected by the humidity sensor is equal to or higher than the predetermined threshold humidity, the rotation speed of the collection roller is increased and/or the rotational direction of the collection roller is reversed, so that the collection performance of the collection roller is increased. This achieves efficient removal of toner on the image bearing body which contains toner charged in a reverse polarity.

The cleaning device may further comprise a time counting section for counting a duration period during which a cleaning operation is stopped. The controller sets the rotational speed of the collection roller at higher speed for a predetermined time period when the duration period counted by the time counting section exceeds a predetermined threshold duration period. When the duration of the stop of cleaning operation continues for prolonged time period (such as 10 days), the brush fibers of the cleaning brush curl or incline permanently in the portions contacting with the image bearing body and the collection roller. When the duration of the stop of cleaning operation measured by the time counting section exceeds the threshold duration length, the rotation speed of the collection roller rotating in the forward direction is increased. This corrects the permanent inclination in the brush fibers, and hence recovers the cleaning performance.

A second aspect of the invention provides a cleaning device comprising, a cleaning brush for removing toner from an image bearing body provided with a plurality of brush fibers in an outer periphery thereof, and adapted to be rotated in a state that the brush fibers are contacting with the image bearing body, a collection roller for collecting the toner from the cleaning brush adapted to be rotated with contacting to the cleaning brush, and a controller for controlling rotational operations of the cleaning brush and the collection roller so that that the cleaning brush starts rotating after the collection roller starts rotating. Toner pulverized and scattered during the preceding cleaning operation accumulates on the cleaning brush while the cleaning operation is stopped. Owing to that the collection roller starts rotating before the cleaning brush starts rotating, the toner accumulated on the cleaning brush is removed. Thus, high cleaning performance is obtained even at an early stage after cleaning operation starts.

The controller preferably controls the rotational operations of the cleaning brush and the collection roller so that the collection roller stops rotating after the cleaning brush stops rotating. The toner pulverized during the cleaning operation accumulates on the cleaning brush especially immediately after the stop of cleaning operation. Owing to that the collection roller stops rotating after the cleaning brush stops rotating at the stop of cleaning operation, the toner is prevented from accumulating on the cleaning brush immediately after the stop of cleaning operation.

A third aspect of the invention provides a cleaning device comprising, a cleaning brush for removing toner from an image bearing body provided with a plurality of brush fibers in an outer periphery thereof, and adapted to be rotated in a state that the brush fibers are contacting with the image bearing body, a collection roller for collecting the toner from the cleaning brush adapted to be rotated with contacting to the cleaning brush, and a drive mechanism for moving the collection roller between a first position where the collection roller is in contact with the cleaning brush and a second position where the collection roller is spaced to the cleaning brush. Specifically, the cleaning device further comprises a controller for controlling the rotational operation of the cleaning brush and the operation of the drive mechanism so that the cleaning brush starts rotating after the collection roller moves from the second position to the first position. Owing to that the collection roller is maintained out of contact with the cleaning brush during the stop of cleaning operation, permanent inclination in the brush fibers is avoided which could occur if the cleaning brush were maintained in contact with the collection roller for a long time.

Further, the controller controls the drive mechanism so that the collection roller moves from the first position to the second position after the cleaning brush stops rotating.

A fourth aspect of the invention provides an image forming apparatus comprising, a plurality of photoconductors which are arranged along a carrying direction of an intermediate transfer member and on each of which a toner image is formed, a plurality of primary transfer sections each of which transfers electrostatically the toner image on the photoconductor corresponding thereto onto the intermediate transfer member, a secondary transfer section for transferring electrostatically the toner image on the intermediate transfer member onto a recording medium, a cleaning brush for removing toner from the intermediate transfer member provided with a plurality of brush fibers in an outer periphery thereof, and adapted to be rotated in a state that the brush fibers are contacting with the intermediate transfer member, a collection roller for collecting the toner from the cleaning brush adapted to be rotated with contacting to the cleaning brush, and a controller for controlling rotational operations of the cleaning brush and the collection roller so that that the cleaning brush starts rotating after the collection roller starts rotating.

A fifth aspect of the invention provides an image forming apparatus comprising, a plurality of photoconductors which are arranged along a carrying direction of an intermediate transfer member and on each of which a toner image is formed, a plurality of primary transfer sections each of which transfers electrostatically the toner image on the photoconductor corresponding thereto onto the intermediate transfer member, a secondary transfer section for transferring electrostatically the toner image on the intermediate transfer member onto a recording medium, a cleaning brush for removing toner from the intermediate transfer member provided with a plurality of brush fibers in an outer periphery thereof, and adapted to be rotated in a state that the brush fibers are contacting with the intermediate transfer member, a collection roller for collecting the toner from the cleaning brush adapted to be rotated with contacting to the cleaning brush, and a controller a drive mechanism for moving the collection roller between a first position where the collection roller is in contact with the cleaning brush and a second position where the collection roller is spaced to the cleaning brush.

A sixth aspect of the invention provides an image forming apparatus comprising, a plurality of photoconductors which are arranged along a carrying direction of an intermediate transfer member and on each of which a toner image is formed, a plurality of primary transfer sections each of which transfers electrostatically the toner image on the photoconductor corresponding thereto onto the intermediate transfer member, a secondary transfer section for transferring electrostatically the toner image on the intermediate transfer member onto a recording medium, a cleaning brush for removing toner from the intermediate transfer member provided with a plurality of brush fibers in an outer periphery thereof, and adapted to be rotated in a state that the brush fibers are contacting with the intermediate transfer member, a collection roller for collecting the toner from the cleaning brush adapted to be rotated with contacting to the cleaning brush, and a controller for controlling rotational operations of the cleaning brush and the collection roller so that the collection roller rotates in such a manner that the collection roller and the cleaning brush move in the same direction with each other at a contact area between the collection roller and the cleaning brush, and so that a circumferential speed ratio of the collection roller with respect to the cleaning brush is greater than one and smaller than two.

The controller of the image forming apparatus preferably increases the rotational speed of the collection roller and/or reverses the rotational direction of the collection roller in a predetermined situation, so as to improve the collection performance of the collection roller.

For example, the controller preferably improves the collection performance of the collection roller during the process of image stabilization. The image stabilization process includes image density adjustment and resist adjustment. During the image density adjustment and the resist adjustment, a larger amount of toner is carried on the intermediate transfer member than in the case of normal image formation. Thus, owing to that the collection performance of the collection roller is improved during the image stabilization process, the toner on the intermediate transfer member is removed efficiently.

Further, the controller preferably improves the collection performance of the collection roller during color image formation. During the color image formation, a larger amount of toner is carried on the intermediate transfer member than in the case of monochromatic image formation. Thus, owing to that the collection performance of the collection roller is improved during the color image formation, the toner on the intermediate transfer member is removed efficiently.

Furthermore, the controller preferably improves the collection performance of the collection roller for a predetermined time duration length when the first cleaning operation is performed after occurrence of jamming of a recording medium. When the jamming occurs, the toner image is not transferred to the recording medium, and hence remains on the intermediate transfer member. As a result, a larger amount of the toner is carried on the intermediate transfer member than in the normal operation. Thus, owing to that the collection performance of the collection roller is improved when the first cleaning operation is performed after the occurrence of a jam of a recording medium, the toner on the intermediate transfer member is removed efficiently.

Further, the controller preferably sets the rotational speed of the collection roller at higher speed for a predetermined time period when the first cleaning operation is performed after factory shipment. When the first cleaning operation is performed after factory shipment, the brush fibers of the cleaning brush curl or incline permanently in the portions contacting with the intermediate transfer member and the collection roller. Thus, owing to that the rotational speed of the collection roller is set at higher speed when the first cleaning operation is performed after factory shipment, the permanent inclination is corrected in the brush fibers, so that the cleaning performance is recovered.

BRIEF DESCRIPTION OF THE DRAWINGS

These and other objects and features of the invention will become apparent from the following description taken in conjunction with preferred embodiments of the invention with reference to the accompanying drawings, in which.

DETAILED DESCRIPTION OF THE PREFERRED EMBODIMENTS

Preferred embodiments of the invention are described below in detail with reference to the accompanying drawings.

First Embodiment

Figure 1:
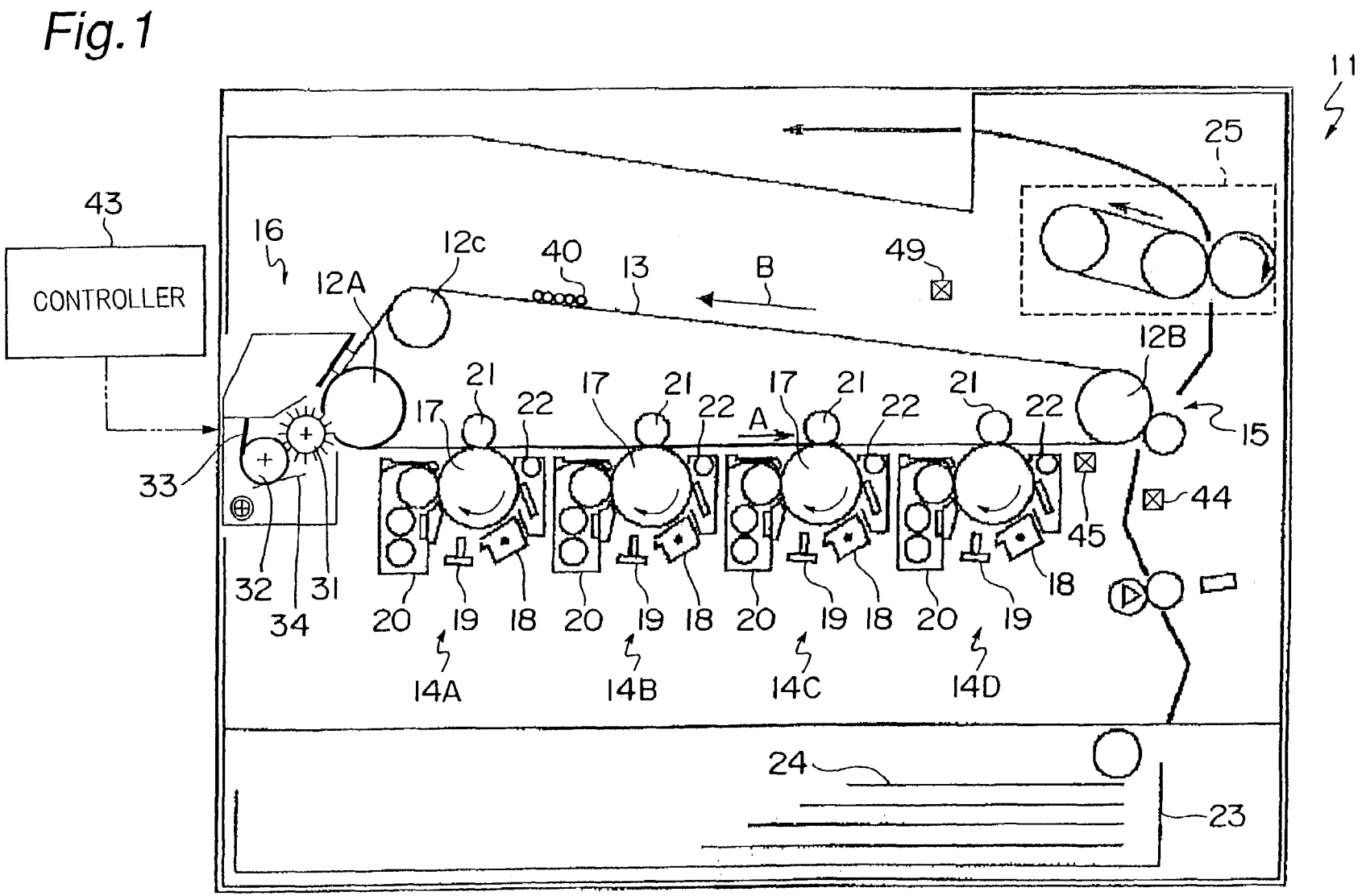
FIG. 1 is a schematic configuration diagram showing an image forming apparatus comprising a cleaning device according to first embodiment of the present invention.

FIG. 1 shows a laser printer 11 of tandem process type serving as an image forming apparatus according to an embodiment of the present invention. In the present embodiment, a normal charging polarity of toner is assumed to be negative.

An intermediate transfer belt 13 (referred to as a transfer belt hereinafter) stretched on support rollers 12A, 12B, and 12C is forwarded in a direction indicated by an arrow B by rotation of the support rollers 12A-12C. Around the transfer belt 13, there are disposed first through fourth image forming units 14A-14D, a secondary transfer device 15, and a secondary cleaning device 16 (referred to as a cleaning device hereinafter).

The image forming units 14A-14D respectively transfers images of yellow (Y), magenta (M), cyan (C), and black (Br) onto the transfer belt 13. The image forming units 14A-14D have the same structure with each other, and each unit comprises a charging device 18, an exposure device 19, a developing device 20, a primary transfer device 21, and a primary cleaning device 22 which are arranged around a photoconductor drum 17. The surface of the photoconductor drum 17 uniformly charged by the charging device 18 undergoes the process of exposure with laser light projected from the exposure device 19, so that an electrostatic latent image is formed. The electrostatic latent image is developed into a toner image with toner supplied from the developing device 20. The toner image is transferred electrostatically to the surface of the transfer belt 13 by a positive voltage applied on a backside of the transfer belt 13 by the primary transfer device 21. Toner remaining on the surface of the photoconductor drum 17 after the primary transfer is collected by the primary cleaning device 22.

In case of a color image, a toner image is transferred and overlaid onto the transfer belt 13 at each time when the transfer belt 13 passes through each of the image forming units 14A-14D. In contrast, in case of a monochromatic image, a toner image is transferred to the transfer belt 13 by the image forming unit 14D alone. The toner image transferred to the transfer belt 13 is electrostatically transferred by the secondary transfer device 15 onto a recording medium 24 such as a paper sheet transported from a paper feed cassette 23. More specifically, the toner image is transferred from the transfer belt 13 to the recording medium 24 by a positive voltage applied on the backside of the recording medium 24. The recording medium 24 carrying the toner image is transported to a fixing device 25, so that the image is fixed on the recording medium 24 by pressurization and heating.

Figure 2:
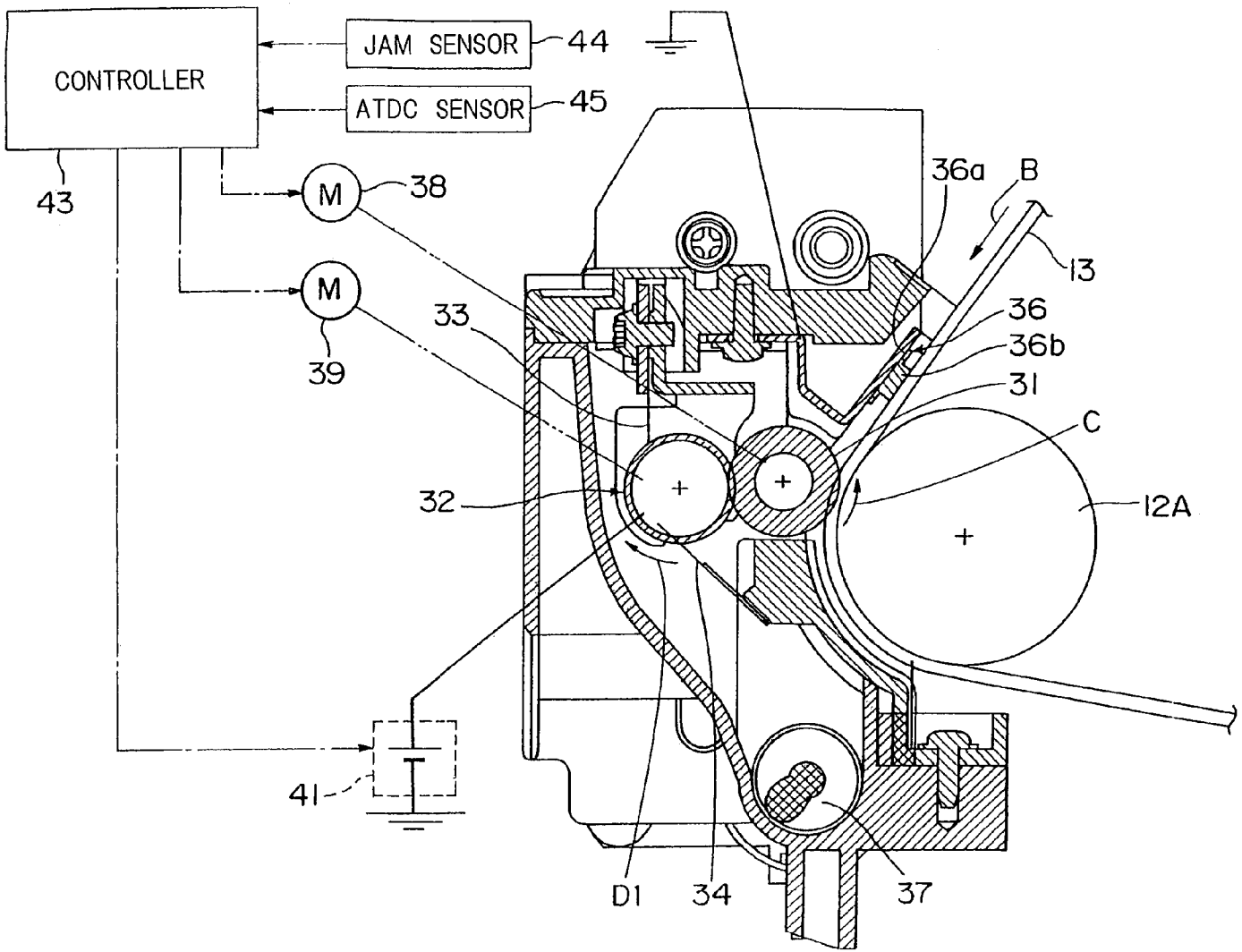
FIG. 2 is a cross sectional view showing a cleaning device according to the first embodiment of the present invention.

The cleaning device 16 is described below with reference to FIGS. 2 and 3. The cleaning device 16 comprises a cleaning brush 31, a collection roller 32, a scraper 33, a seal member 34, an electrically conductive brush 36, and a transport screw 37 (shown only in FIG. 2).

Figure 3:
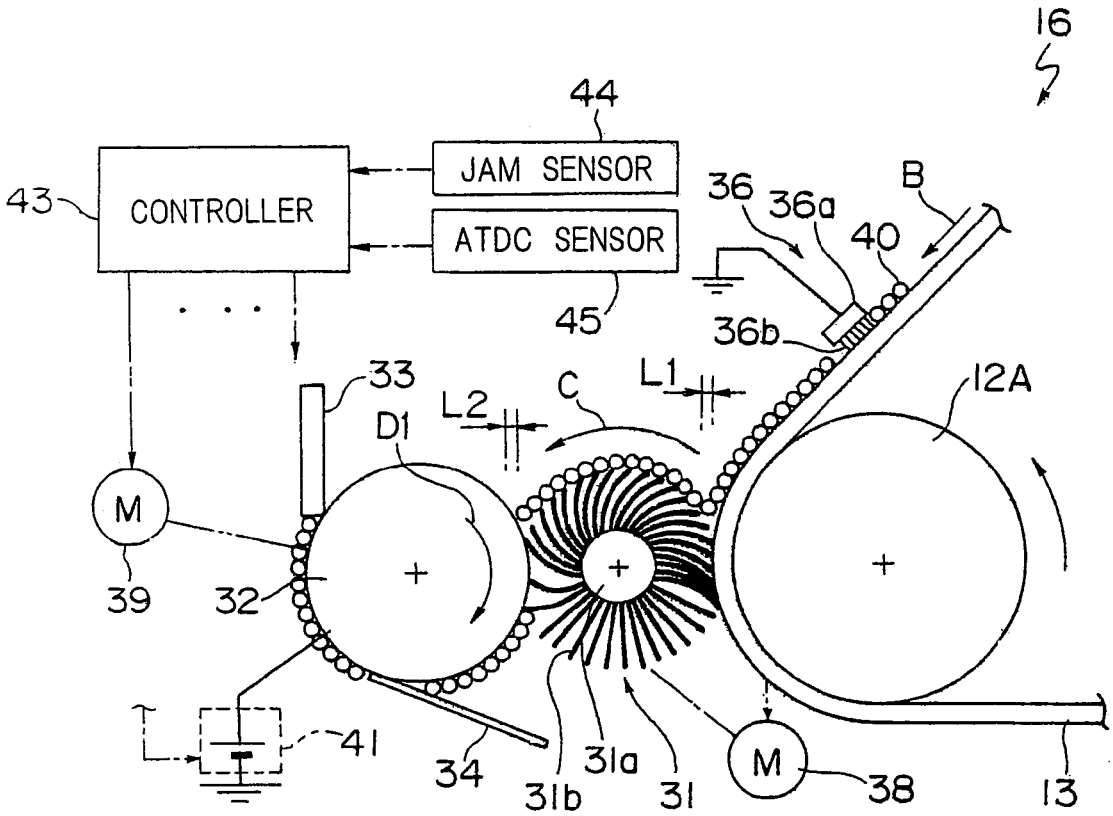
FIG. 3 is a schematic diagram showing a cleaning device according to the first embodiment of the present invention.

As shown in FIG. 3, the cleaning brush 31 is provided with a core metal 31*a* composed of a solid or hollow bar formed of an electrically conductive material such as metal, and a large number of electrically conductive hairs or brush fibers 31*b* implanted in an outer periphery of the core metal 31*a*. More specifically, the brush fibers 31*b* are woven into an electrically conductive fabric substrate which is wound and bonded around the core metal 31*a*. The fabric substrate may be coated with electrically conductive agent on the side facing the core metal 31*a* or on both sides. The brush fibers 31*b* are composed of resin such as nylon, polyester, acrylic, rayon, or the like in which carbon is dispersed for electrical conductivity. The brush fibers 31*b* has a fibril diameter of approximately 1-10 D, a fibril density of approximately 50-300 kF, and a fibril resistance of approximately $10^3$ Ω or higher. In the present embodiment, each of the brush fibers 31*b* has a fibril diameter of 6 D, a fibril density of approximately 75-100 kF, and a fibril resistance of $10^6$-$10^{11}$ Ω.

The cleaning brush 31 contacts with the transfer belt 13 in a state that a nip portion is formed. The amount L1 of the nip portion of the cleaning brush 31 against the transfer belt 13 (see FIG. 3) is set within a range of approximately 0.5-2.0 mm, and is 1.0 mm in the present embodiment. The cleaning brush 31 is driven to be rotated by a drive mechanism 38 provided with a motor and a transmission mechanism. In the present embodiment, as shown in FIG. 3, a rotational direction (arrow C) of the cleaning brush 31 is reverse to a rotational direction (arrow B) of the transfer belt 13. That is, the cleaning brush 31 and the transfer belt 13 move in the reverse directions with each other at a contact area point between them. As described later in detail, the drive mechanism 38 can adjust a rotation rate of the cleaning brush 31.

The collection roller 32 is composed of a solid or hollow bar formed with an electrically conductive material such as metal and electrically conductive resin. The surface of the collection roller 32 may be processed by polishing, plating, coating, or the like in order to reduce the friction. Such processing suppresses the wear in the scraper 33 at the point of contact with the collection roller 32, and further improves the collection performance for the toner 40.

The collection roller 32 contacts with the cleaning brush 31 in a state that a nip portion is formed. The amount L2 (see FIG. 3) of the nip portion of the collection roller 32 against the cleaning brush 31 is set within a range of approximately 0.5-2.0 mm, and is 1.0 mm in the present embodiment. The collection roller 32 is driven to be rotated by a drive mechanism 39 provided with a motor and a transmission mechanism. In the present embodiment, as shown in FIG. 3, a rotational direction (arrow D1) of the collection roller 32 is forward relative to the rotational direction (arrow C) of the cleaning brush 31. In other words, the collection roller 32 and the cleaning brush 31 move in the same direction with each other at a contact area between them.

The scraper 33 is composed of a fixed metal or rubber blade. A tip of the scraper 33 is in contact with the surface of the collection roller 32. A pressing angle, nip amount, pressing force, and the like of the scraper 33 are set depending on the type of the toner 40, the material and dimensions of the collection roller 32, and the like. The scraper 33 mechanically scrapes the toner 40 on the surface of the collection roller 32. Thus, the toner 40 is pulverized and scattered. In order to prevent the scattered toner 40 from adhering to the cleaning brush 31, the scraper 33 is preferably arranged away from the cleaning brush 31 by 90° or greater in the downstream of the rotational direction (arrow D1) of the collection roller 32. In case that the scraper 33 is composed of a metal blade, it is preferable that the scraper 32 has a acute tip angle and a thin thickness in order that the toner 40 having a small grain size is surely removed reliably. Further, in this case of the metal blade, the tip may be treated by a chemical process such as edging in order to improve precision in the edge contacting with the collection roller 32. Furthermore, the tip of the metal blade may be treated by a friction reducing process such as plating, baking, and coating for preventing tip wear prevention and hardening. In the present embodiment, the scraper 33 is composed of a metal blade of stainless steel, and has a thickness of 0.5 mm. Further, the tip of the scraper 33 is processed by edging.

The seal member 34 prevents that the toner 40 having been pulverized when scraped from the collection roller 32 by the scraper 33 is transported and reattached to the transfer belt 13 by air flow caused by the cleaning brush 31. In the present embodiment, the seal member 34 is made of a plastic film. A tip of the seal member 34 is in surface contact with the surface of the collection roller 32. The contact pressure of the seal member 34 against the collection roller 32 is set at such a low value that the seal member 34 does not scrape the toner 40 on the collection roller 32.

The electrically conductive brush 36 is provided with an electrically conductive base 36*a* and a large number of electrically conductive brush fibers 36*b* implanted into the base 36*a*. The electrically conductive brush 36 is arranged in the upstream of the cleaning brush 31 in the direction of forwarding (arrow B) of the transfer belt 13. The brush fibers 36*b* are in contact with the surface of the transfer belt 13. The base 36*a* is grounded. The electrically conductive brush 36 may be replaced by another electrically conductive member such as an electrically conductive film.

A bias voltage is applied to the cleaning brush 31 from a power supply 41 through the collection roller 32. The polarity of the bias voltage (positive) is reverse to the normal charging polarity for the toner 40 on the transfer belt 13 (negative). More specifically, the power supply 41 is connected to the collection roller 32, so that the electrically conductive brush 36 is connected indirectly to the power supply 41 via the collection roller 32. Since the electrically conductive brush 36 is grounded as described above, a closed circuit is formed from the power supply 41 to the electrically conductive brush 36 through the collection roller 32, the cleaning brush 31, and the transfer belt 13. Between the brush fibers 31*b* of the cleaning brush 31 and the transfer belt 13, the current flowing through the closed circuit generates an electric field (cleaning electric field) in a direction generating a force causing the toner 40 of the normal charging polarity to be absorbed electrostatically from the transfer belt 13 to the brush fibers 31*b*. On the other hand, between the brush fibers 36*b* of the electrically conductive brush 36 and the transfer belt 13, an electric field is generated in the reverse direction to the cleaning electric field. The circuit for applying the bias voltage to the cleaning brush 31 is not limited to this configuration. For example, the power supply 41 may be a constant current power supply or constant voltage power supply. Further, the power supply 41 may be connected to the core metal 31*a* of the cleaning brush 31. Furthermore, a power supply may be connected to the electrically conductive brush 36 with the cleaning brush 31 being grounded.

The toner 40 remaining on the transfer belt 13 even after passing through the secondary transfer device 15 (see FIG. 1) reaches the electrically conductive brush 36 and passes the nip portion of the electrically conductive brush 36 against the transfer belt 13. As described above, an electric field in the reverse direction to the cleaning electric field is generated between the electrically conductive brush 36 and the transfer belt 13. Thus, the toner 40 charged in the reverse polarity (positive) to the normal charging polarity is charged into the normal charging polarity (negative) during the passage through the electrically conductive brush 36. At the contact area between the cleaning brush 31 and the transfer belt 13, the toner 40 is mechanically scraped by the cleaning brush 31 rotating in the reverse direction relative to the transfer belt 13. Further, owing to the cleaning electric field generated between the cleaning brush 31 and the transfer belt 13, the toner 40 on the transfer belt 13 is absorbed electrostatically to the cleaning brush 31. Since the cleaning brush 31 has a potential difference from the collection roller 32, the toner 40 collected by the cleaning brush 31 moves to the collection roller 32. The toner 40 on the collection roller 32 is mechanically scraped by the scraper 33. The toner 40 scraped by the scraper 33 is transported to the outside of the cleaning device 16 by the transport screw 37. The seal member 34 prevents that the toner 40 having been pulverized when scraped by the scraper 33 is scattered to the transfer belt 13.

A controller 43 is provided with various components such as a CPU, RAM, ROM, clock, and the like, so as to control an operation of the laser printer 11 including the cleaning device 16. In the present embodiment, a jam sensor 44 for detecting jamming of the recording medium 24 is arranged in the laser printer 11. The jam sensor 44 outputs to the controller 43 a signal indicating an occurrence or absence of jamming. An AIDC (Automatic Image Density Control) sensor 45 is arranged between the image forming unit 14D located in the most downstream of the direction of forwarding of the transfer belt 13 and the secondary transfer device 15.

As described later in detail, the controller 43 switches the rotation rate per unit time of the collection roller 32 between a standard rotation rate $R_s$ and a high rotation rate $R_h$ which is higher than the standard rotation rate $R_s$. The rotation rate per unit time of the cleaning brush 31 is constant. The standard rotation rate $R_s$ and the high rotation rate $R_h$ are set such that ratio $PV_1/PV_2$ of the circumferential speed $PV_1$ of the collection roller 32 to the circumferential speed $PV_2$ of the cleaning brush 31 is greater than one and smaller than two. In other words, the circumferential speed ratio $PV_1/PV_2$ is set such as to satisfy the following equation (1).

$$1<PV_1/PV_2<2 \quad (1)$$

In the present embodiment, the circumferential speed ratio $PV_1/PV_2$ is 1.02 when the collection roller 32 rotates at the standard rotation rate $R_s$. The circumferential speed ratio $PV_1/PV_2$ is 1.8 when the collection roller 32 rotates at the high rotation rate $R_h$.

Figure 4:
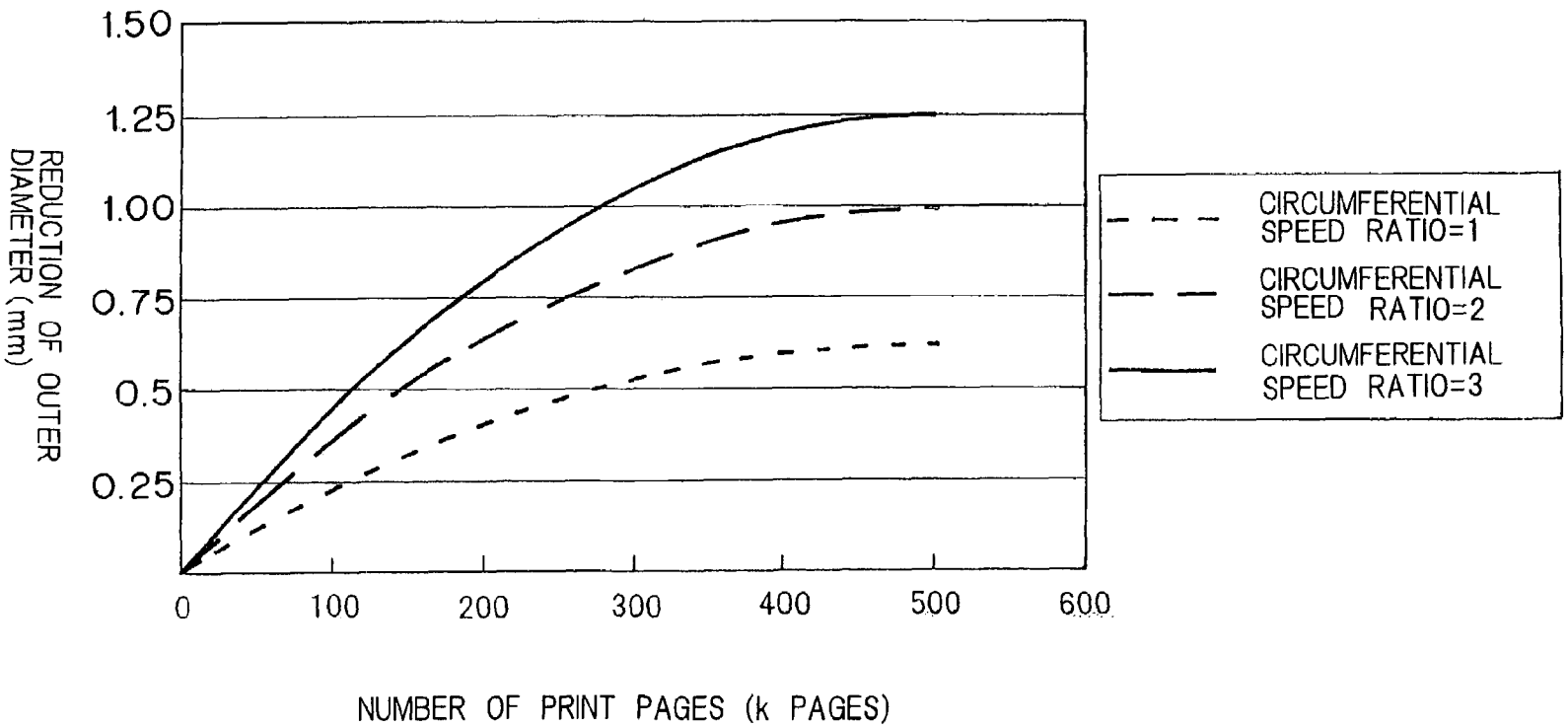
FIG. 4 is a graph showing the relation between the number of print pages and the amount of reduction in the outer diameter of a cleaning brush.
Figure 5:
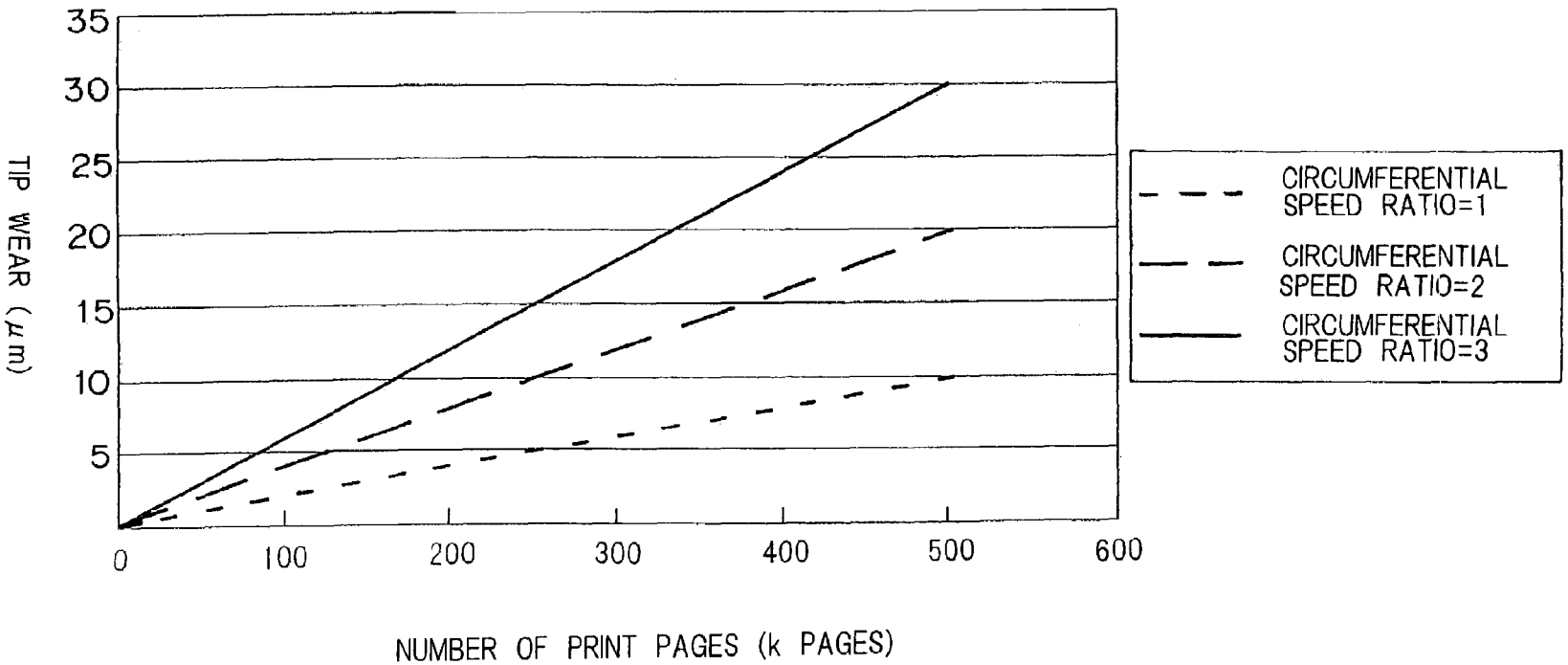
FIG. 5 is a graph showing the relation between the number of print pages and the amount of tip wear in a scraper.
Figure 6:
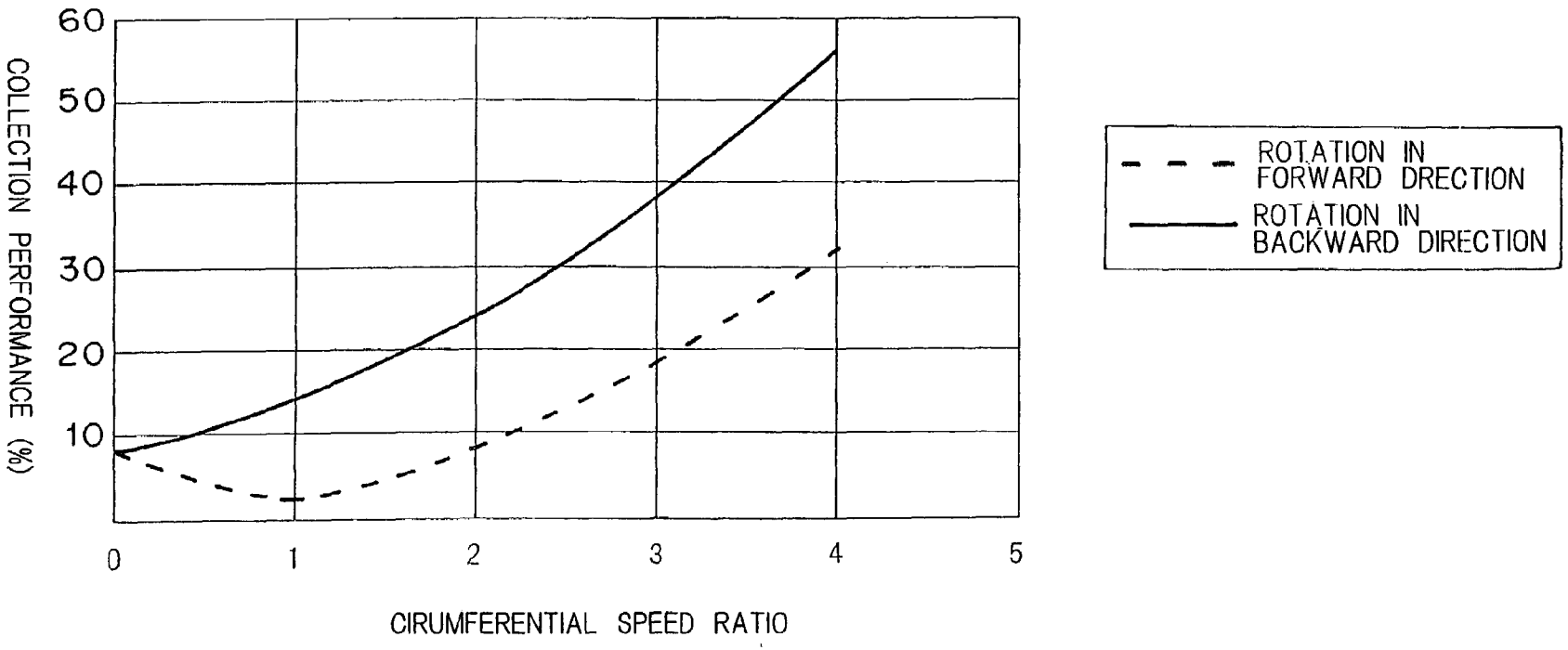
FIG. 6 is a graph showing the relation between the circumferential speed and the collection performance.

The reason is described below why the circumferential speed ratio $PV_1/PV_2$ is set within the range of equation (1). FIG. 4 shows a result of measurement of the relation between the number of print pages and the amount of reduction in an outer diameter of the cleaning brush 31, which was measured for the circumferential speed ratios $PV_1/PV_2$ of 1, 2, and 3. As seen from FIG. 4, in case that the circumferential speed ratio $PV_1/PV_2$ falls between 1 and 2, the amount of reduction in the outer diameter is suppressed as small as approximately 0.65-1.0 mm even when the number of print pages reaches 5000 k pages. In contrast, in case that the circumferential speed ratio $PV_1/PV_2$ is 3, the amount of reduction in the outer diameter becomes approximately 1.25 mm when the number of print pages reaches 5000 k pages, which shows degradation of the cleaning performance of the cleaning brush 31 owing to the outer diameter reduction. FIG. 5 shows a result of measurement of the relation between the number of print pages and the amount of tip wear in the scraper 33, which was measured for the circumferential speed ratios $PV_1/PV_2$ of 1, 2, and 3. As seen from FIG. 5, in case that the circumferential speed ratio $PV_1/PV_2$ falls between 1 and 2, the amount of tip wear is suppressed as small as approximately 10-20 μm even when the number of print pages reaches 5000 k pages. In contrast, in case that the circumferential speed ratio $PV_1/PV_2$ is 3, the amount of tip wear becomes approximately 30 μm when the number of print pages reaches 5000 k pages, which shows degradation of the cleaning performance of the cleaning brush 31 owing to the wear in the scraper 33. In FIG. 6, a broken line indicates the relation between the circumferential speed and the collection performance when the collection roller 32 rotates in the forward direction relative to the cleaning brush 31. As seen from FIG. 6, in case that the circumferential speed ratio $PV_1/PV_2$ is greater than 1 and smaller than 2, the collection performance is 3-9%, which is satisfactory in practice. As a result, when the circumferential speed ratio $PV_1/PV_2$ is set within the range greater than 1 and smaller than 2, the outer diameter reduction caused by permanent inclination in the brush fibers 31*b* of the cleaning brush 31 and the tip wear in the scraper 33 is avoidable. This permits efficient collection of the toner 40 from the transfer belt 13 even after a long time use. It should be noted that FIG. 6 shows the collection performance when no bias voltage is applied and hence a mechanical effect is solely adapted. When a bias voltage is applied, the collection performance reaches 60-80%.

Figure 7:
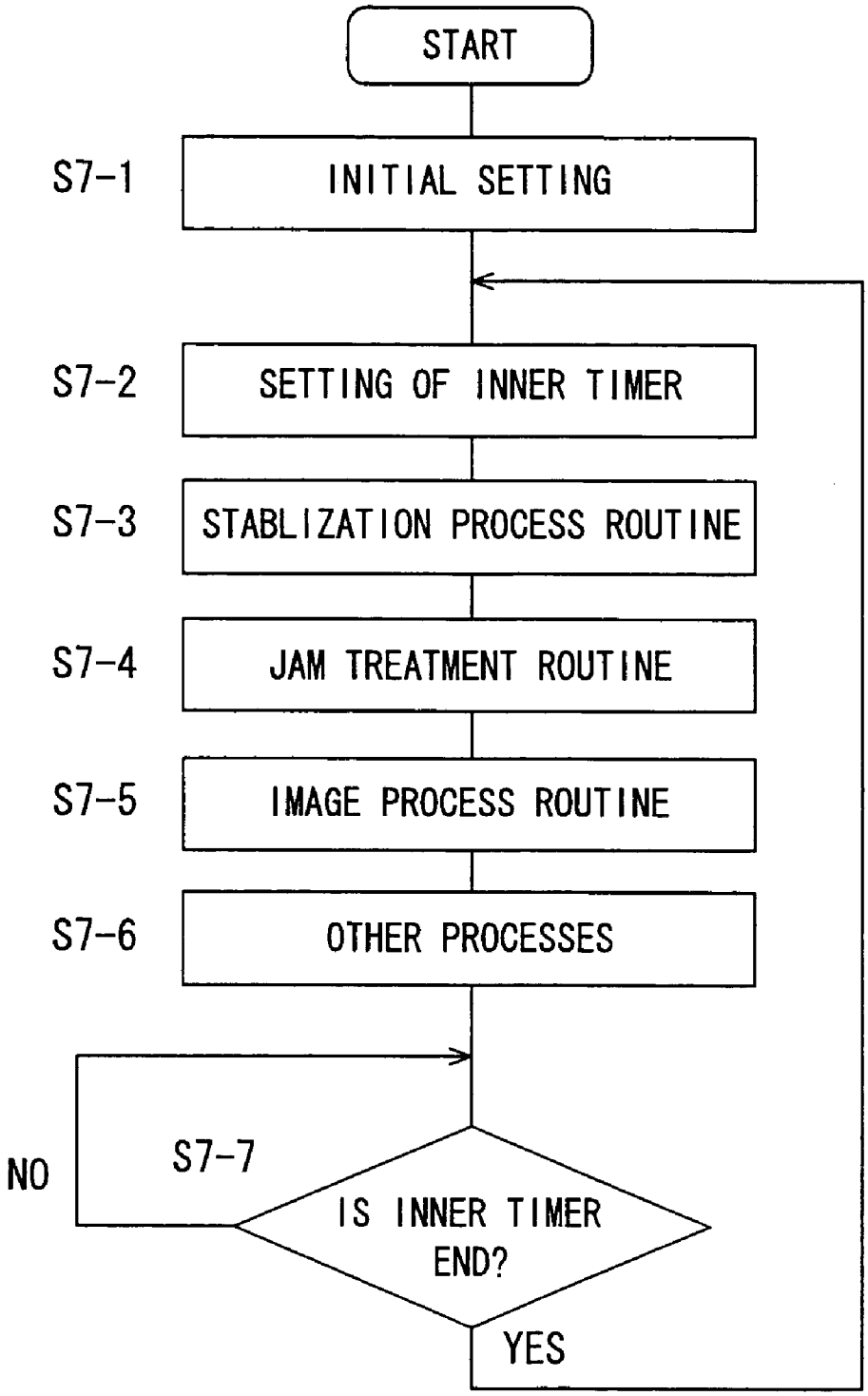
FIG. 7 is a flowchart illustrating the operation of an image forming apparatus.

FIG. 7 shows the overall operation of the laser printer 11 of the present embodiment. An initial setting in step S7-1 is performed only during the fabrication or at the time of shipment. In the initial setting, a flag (shipment flag $FL_{sh}$) indicating whether or not the laser printer 11 has been operated at least once after the shipment is set at "1". The value "1" of the shipment flag $FL_{sh}$ indicates that the laser printer 11 has not yet been operated even once after the shipment. In contrast, a value "0" of the shipment flag $FL_{sh}$ indicates that the laser printer 11 has been operated at least once after the shipment. An internal timer in steps S7-2 and S7-7 is used for performing the following routine operations in the same time period. A stabilization process routine in step S7-3 includes an image density adjustment and a resist adjustment. In the image density adjustment, the image forming units 14A-14D form a plurality of rectangular toner patterns densities of which decrease gradually on the transfer belt 13. Then, on the basis of the densities of these toner patterns detected by the AIDC sensor 45, the amount of exposure is adjusted in the exposure device 19 of each of the image forming units 14A-14D. In the resist adjustment, the image forming units 14A-14D generate linear toner patterns. Then, the distance of these patterns is measured, so that the images of different colors generated by the image forming units 14A-14D are aligned with each other. A jam treatment routine in step S7-4 is performed only when the jam sensor 44 detects the jamming. On completion of the process of the jam treatment routine, a jam-treated flag $FL_j$ is set at "1". In an image processing routine in step S7-5, the toner images generated by the image forming units 14A-14D are transferred actually onto the recording medium 24 via the transfer belt 13. Other processes in step S7-6 includes a process of receiving data transmitted from a computer of a user and then converting the data into printing data, and a process of controlling an energy saving mode in which the power consumption is reduced in the fixing device and the like during a waiting status.

Figure 8:
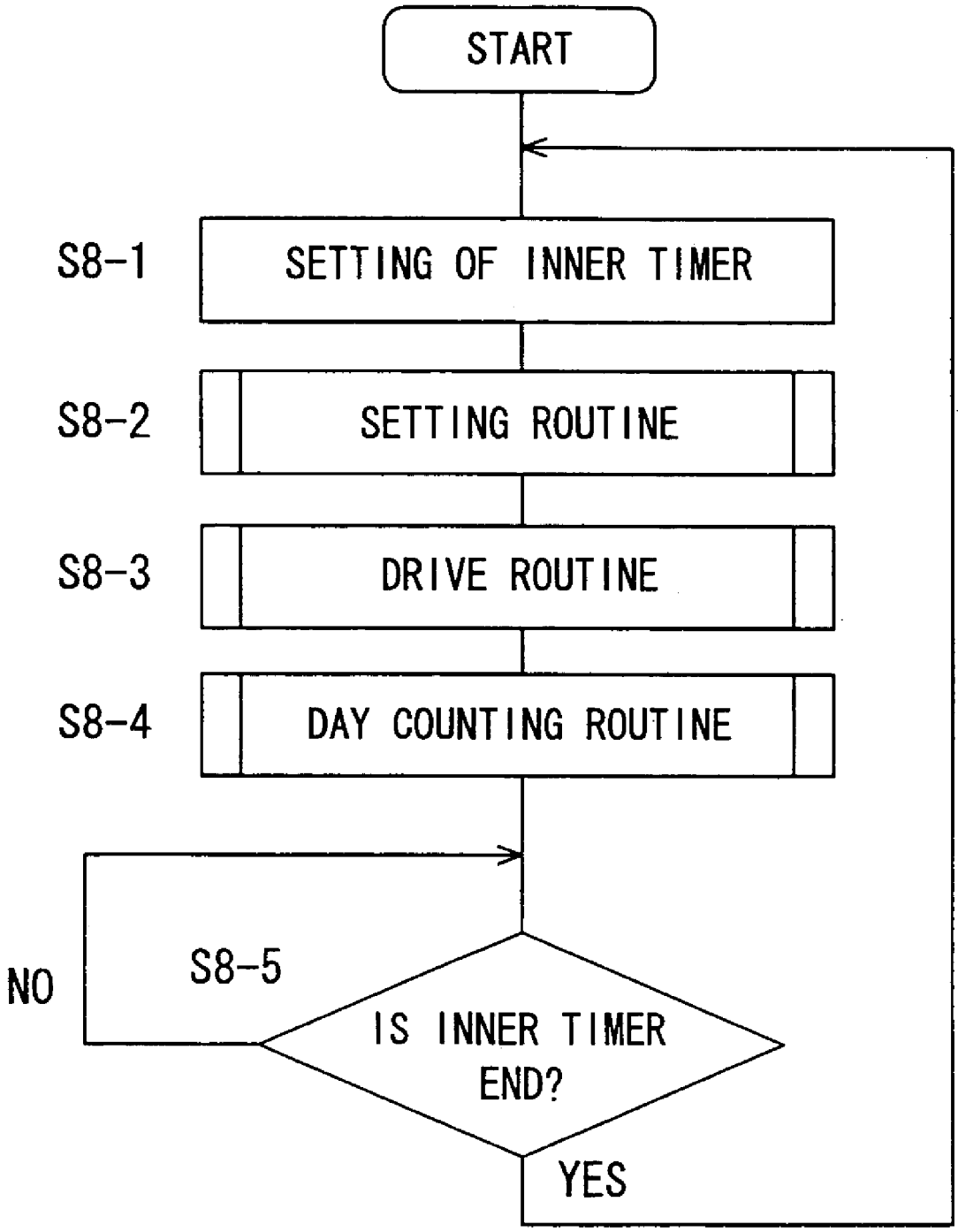
FIG. 8 is a flowchart illustrating the operation of a cleaning device according to the first embodiment of the present invention.

The control of the cleaning device 16 by the controller 43 is described below with reference to FIGS. 8 to 10. In FIG. 8, an internal timer in steps S8-1 and S8-5 is used for synchronizing the control cycles similarly to the case of FIG. 7. A setting routine in step S8-2 sets the rotation rate per unit time of the collection roller 32.

Figure 9:
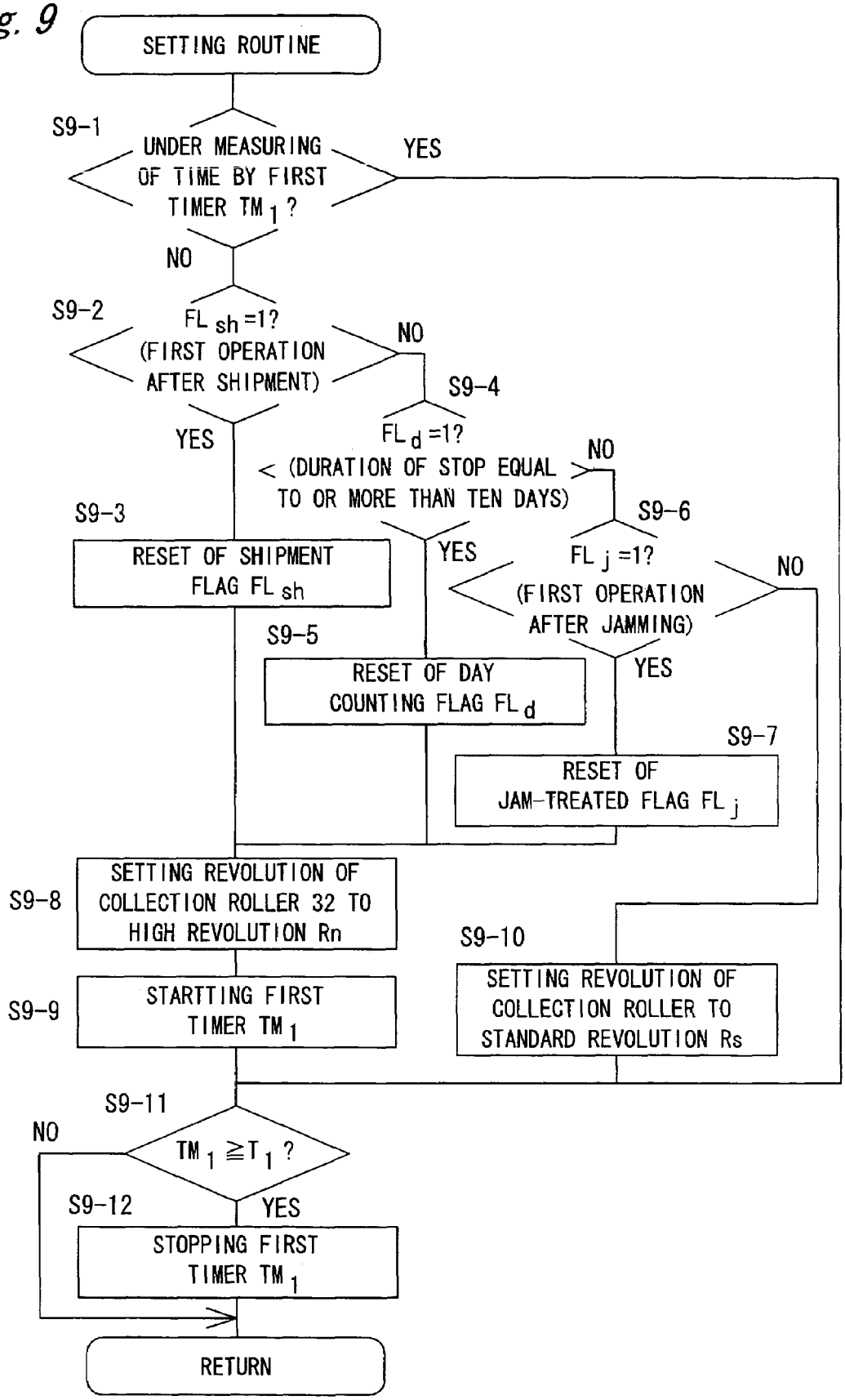
FIG. 9 is a flowchart illustrating a setting routine according to the first embodiment.

FIG. 9 shows detail of the setting routine. In step S9-1, it is determined whether a first timer $TM_1$ is in counting operation or not. The first timer $TM_1$ is used for setting the rotation rate per unit time of the collection roller 32 to be the high rotation rate $R_h$ for a predetermined time length $T_1$ after the startup of the laser printer 11. In case that the first timer $TM_1$ is not in counting operation in step S9-1, the procedure goes to step S9-2. In contrast, in case that the first timer $TM_1$ is already in counting operation in step S9-1, it is determined in step S9-11 whether the first timer $TM_1$ has reached the time length $T_1$ or not. In case that the first timer $TM_1$ has reached the time length $T_1$, the first timer $TM_1$ is stopped in step S9-12. Then, the procedure goes to step S8-3 of FIG. 8.

In step S9-2, in case that the shipment flag $FL_{sh}$ indicates "1", that is, in case that the laser printer 11 is operated at the first time after the shipment, the shipment flag $FL_{sh}$ is reset into "0" in step S9-3. Then, the procedure goes to step S9-8. In contrast, in case that the shipment flag $FL_{sh}$ is not "1", that is, in case that the laser printer 11 has already been operated after the shipment, the procedure goes to step S9-4. In step S9-4, in case that a day counting flag $FL_d$ indicates "1", that is, in case that the duration of the stop of the laser printer 11 has elapsed for a predetermined number of days or longer (10 days in the present embodiment), the day counting flag $FL_d$ is reset into "0" in step S9-5. Then, the procedure goes to step S9-8. In contrast, in step S9-4, in case that a day counting flag $FL_d$ is not "1", that is, in case that the duration of the stop of the laser printer 11 does not reach a predetermined number of days, the procedure goes to step S9-6. In step S9-6, in case that the jam-treated flag $FL_j$ indicates "1", that is, in case that the laser printer 11 is operated at the first time after a jam treatment, the jam-treated flag $FL_j$ is reset into "0" in step S9-7. Then, the procedure goes to step S9-8. In step S9-8, the rotation rate of the collection roller 32 is set at the high rotation rate $R_h$. More specifically, the controller 43 increases the rotation rate per unit time of the drive mechanism 39 for driving the collection roller 32. In step S9-9, time counting is started in the first timer $TM_1$. Then, the procedure goes to step S8-3 of FIG. 8.

The cases that the rotation rate of the collection roller 32 is set at the high rotation rate $R_h$ for a predetermined time length $T_1$ after the startup of the laser printer 11 are limited to the case that the laser printer 11 is operated at the first time after the shipment (step S9-2), the case that the duration of the stop of the laser printer 11 has elapsed for a predetermined number of days or longer (step S9-4), and the case that the laser printer 11 is operated at the first time after a jam treatment (step S9-6). In the case that the laser printer 11 is operated at the first time after the shipment, the same portions in the circumferential direction of the cleaning brush 31 are in contact with the transfer belt 13 and the collection roller 32. Thus, the brush fibers 31*b* in these portions curl or incline permanently. Similarly, in the case that the duration of the stop of the laser printer 11 continues for a long time, the brush fibers 31*b* incline permanently. In these cases, by increasing the rotation rate of the collection roller 32 rotating in the forward direction, the effect of the collection roller 32 correcting the permanent inclination in the brush fibers is improved, and hence the cleaning performance is recovered. In the case of a jam, the laser printer 11 stops in a state that the toner image not transferred to the recording medium 24 remains on the transfer belt 13. Thus, when the laser printer 11 is operated at the first time after a jam treatment, a large amount of toner 40 is remaining on the transfer belt 13. Thus, the increased rotation rate of the collection roller 32 improves the collection efficiency of the collection roller 32 collecting the toner 40 from the cleaning brush 31 (see FIG. 6). This permits reliable collection of the toner 40 on the transfer belt 13 by the cleaning device 16.

On the other hand, in step S9-6, in case that the laser printer 11 has been operated already after the preceding jam treatment, the rotation rate of the collection roller 32 is set at the standard rotation rate $R_s$ in step S9-10. The rotation rate of the collection roller 32 is set at the standard rotation rate $R_s$ in all the cases other than: the case that the laser printer 11 is operated at the first time after the shipment (step S9-2); the case that the duration of the stop of the laser printer 11 has elapsed for a predetermined number of days or longer (step S9-4); and the case that the laser printer 11 is operated at the first time after the jam treatment (step S9-6). This avoids the advancement of tip wear in the scraper 33 which could be caused by an excessively long operation at the high rotation rate $R_h$.

The drive routine in step S8-3 of FIG. 8 controls the operation of the cleaning device 16 in the stabilization process routine (step S7-3 of FIG. 7) and the image processing routine (step S7-5 of FIG. 7).

Figure 10:
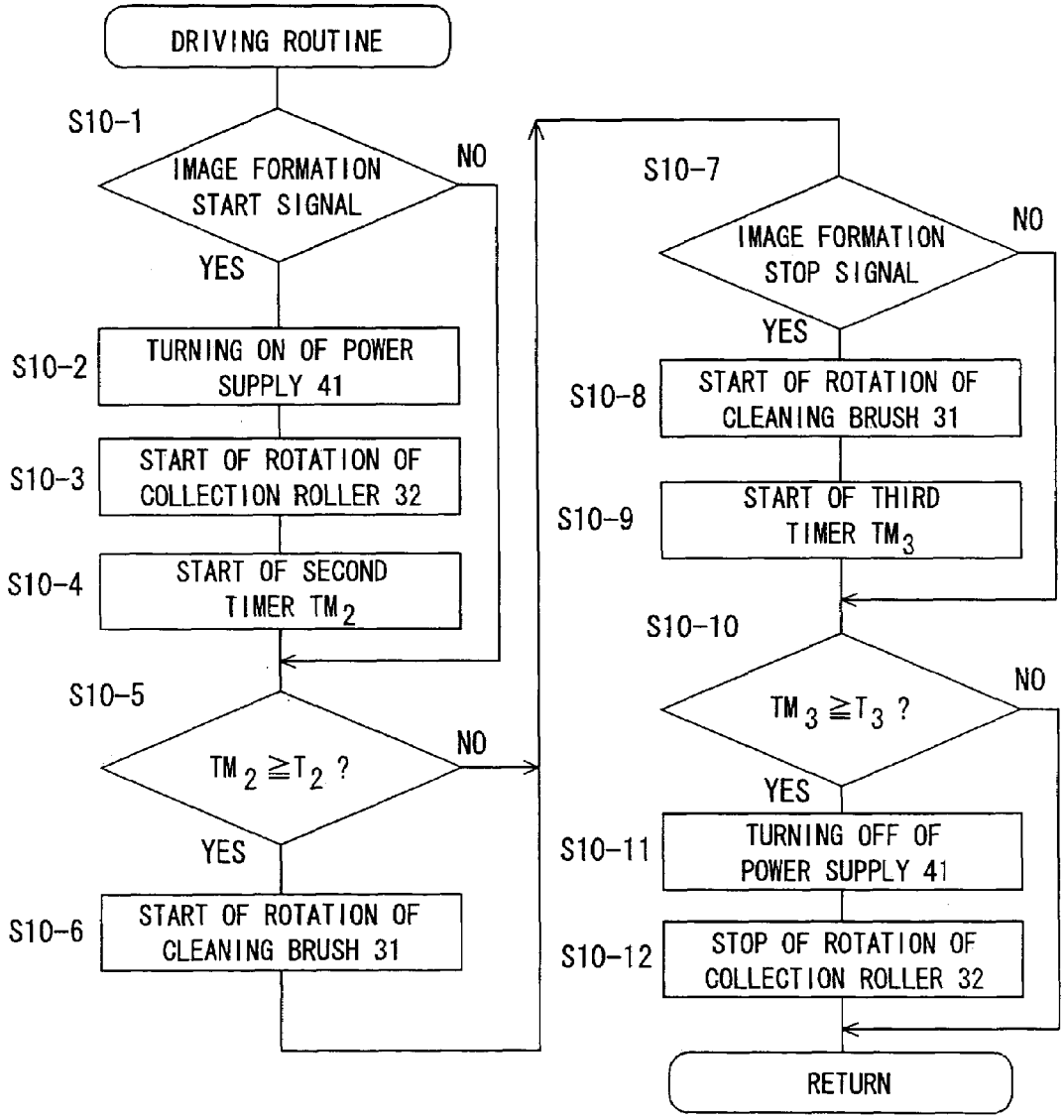
FIG. 10 is a flowchart illustrating a drive routine according to the first embodiment.

FIG. 10 shows detail of the drive routine. In step S10-1 when an image generation start signal (indicating the beginning of an image generation process in the image forming process routine and the stabilization process routine) is inputted, the power supply 41 is turned on in step S10-2. Further, in step S10-3, the drive mechanism 39 starts up so that the collection roller 32 starts rotating. In step S10-4, a second timer $TM_2$ begins time counting. The second timer $TM_2$ is used for realizing such operation that the collection roller 32 solely rotates for a predetermined time length $T_2$ at the startup of the cleaning device 16 and that the cleaning brush 31 starts rotating after the time length. In step S10-5, if the second timer $TM_2$ reaches the time length $T_2$, then the drive mechanism 38 starts up in step S10-6, so that the cleaning brush 31 starts rotating. In step S1-5, if the second timer $TM_2$ does not reach the time length $T_2$, the procedure goes to step S10-7. Further, on completion of step S10-6, the procedure goes to step S10-7.

As a result of the processes of steps S10-1 through S10-6, the collection roller 32 solely starts rotating at the startup of the cleaning device 16. Then, after the time length $T_2$ has been elapsed, the cleaning brush 31 starts rotating. The toner 40 pulverized and scattered during the preceding cleaning operation by the cleaning brush 31, the collection roller 32, and the scraper 33 accumulates on the cleaning brush 31 during the stop of cleaning operation. Owing to that the collection roller 32 starts rotating before the cleaning brush 31 starts rotating at the beginning of cleaning operation, the toner 40 accumulated on the cleaning brush 31 is removed. Thus, high cleaning performance is obtained starting from an early stage of cleaning operation.

In step S10-7, if an image generation stop signal (indicating the stop of an image generation procedure in the image forming process routine and the stabilization process routine) is inputted, the drive mechanism 39 stops in step S10-8, so that the cleaning brush 31 stops rotating. Further, in step S10-9, a third timer $TM_3$ begins time counting. The third timer $TM_3$ is used for realizing such operation that the cleaning brush 31 stops revolving first at the operation stop of the cleaning device and then the collection roller 32 stops rotating after a predetermined time length $T_3$ has elapsed. In step S10-10, if the third timer $TM_3$ reaches the time length $T_3$, then the power supply 41 is turned off in step S10-11. In step S10-12, the drive mechanism 39 stops, so that the collection roller 32 stops rotaing. Then, the procedure goes to step S8-4 of FIG. 8.

As a result of the processes of steps S10-7 through S10-12, the cleaning brush 31 stops rotating first at the end of operation of the cleaning device 16. Then, the collection roller 32 stops rotating after a predetermined time length $T_3$ has elapsed. The toner 40 pulverized during the cleaning operation accumulates on the cleaning brush 31 especially immediately after the stop of cleaning operation. Owing to that the collection roller 32 stops rotating after the cleaning brush 31 stops rotating at the stop of cleaning operation, the toner 40 is prevented from accumulating on the cleaning brush 31 immediately after the stop of cleaning operation.

The time lengths $T_2$ and $T_3$ counted by the timers $TM_2$ and $TM_3$ are set sufficiently shorter than the time length of one operation of the cleaning device 16. The time duration after the second timer $TM_2$ reaches the time length $T_2$ and until the third timer $TM_3$ begins time counting is duration that the toner 40 on the transfer belt 13 is actually collected in the cleaning device 16. As described above, the rotation rate of the collection roller 32 is set at the high rotation rate $R_h$ for a predetermined time length $T_1$ after the startup of the laser printer 11 in the case that the laser printer 11 is operated at the first time after the shipment (step S9-2), in the case that the duration of the stop of the laser printer 11 has elapsed for a predetermined number of days or longer (step S9-4), and in the case that the laser printer 11 is operated at the first time after a jam treatment (step S9-6). After the time length $T_1$ has elapsed, the rotation rate of the collection roller 32 is set at the standard rotation rate $R_s$.

The day counting routine in step S8-4 of FIG. 8 checks the number of days that the stop of operation of the laser printer 11 continues. In view of function, this day counting routine corresponds to a time counting section of the invention.

Figure 11:
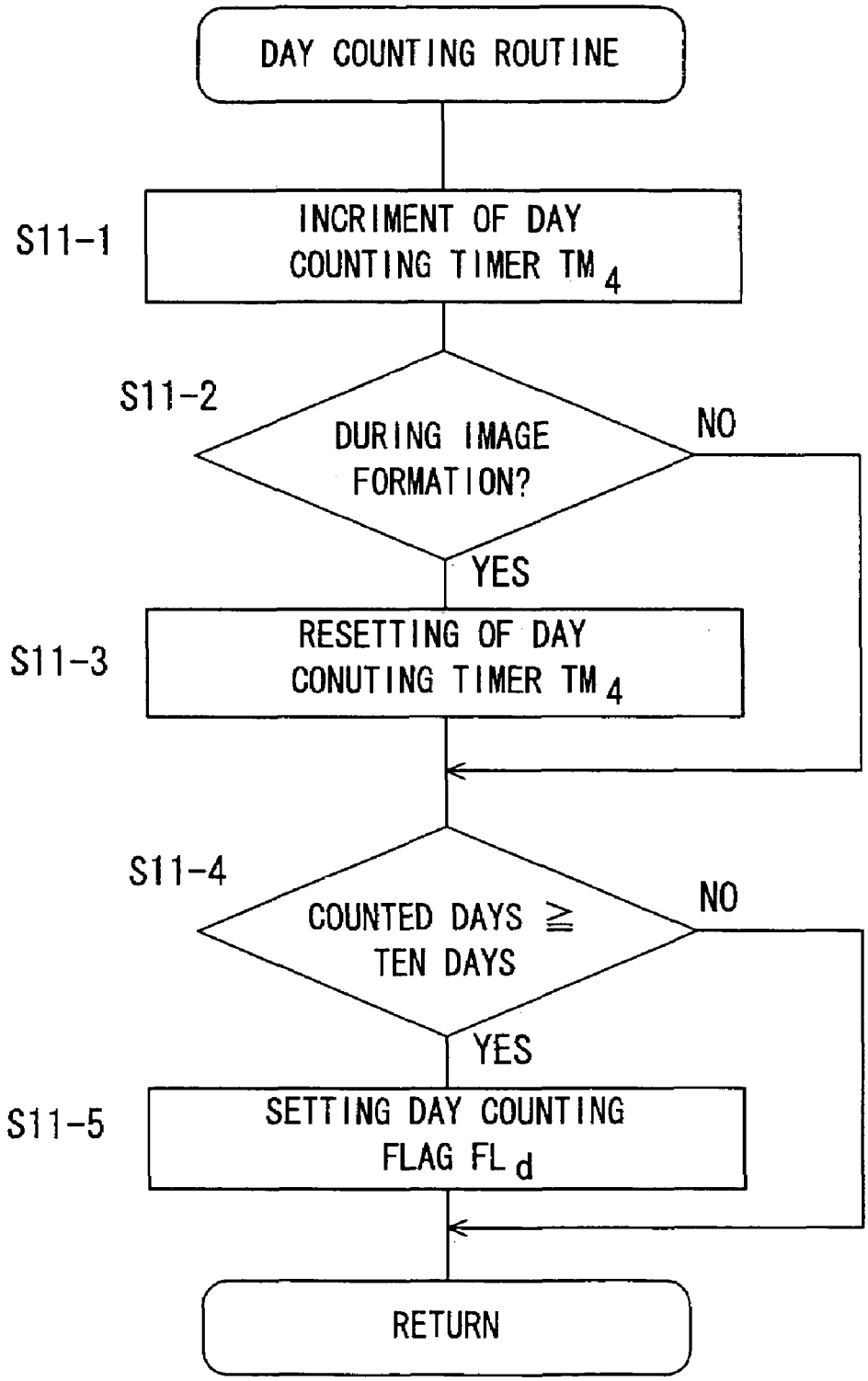
FIG. 11 is a flowchart illustrating a day counting routine.

FIG. 11 shows detail of the day counting routine. In step S11-1, a day counting timer $TM_4$ is incremented by "1". Then, in step S11-2, if the image generation is on going, the day counting timer $TM_4$ is cleared into "0" in step S11-3. In step S11-4, if the number of days counted by the day counting timer $TM_4$ reaches 10 days or longer, a day counting timer flag $FL_d$ is set at "1" in step S11-5.

Second Embodiment

Figure 12A:
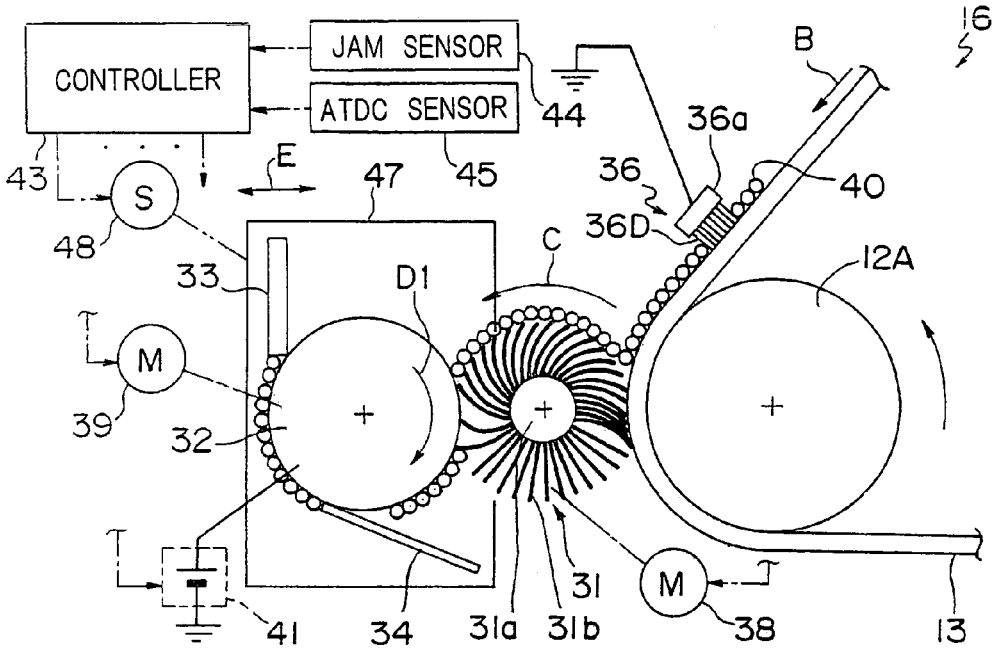
FIG. 12A is a schematic diagram showing a cleaning device according to second embodiment of the present invention (where a collection roller is in contact with a cleaning brush)
Figure 12B:
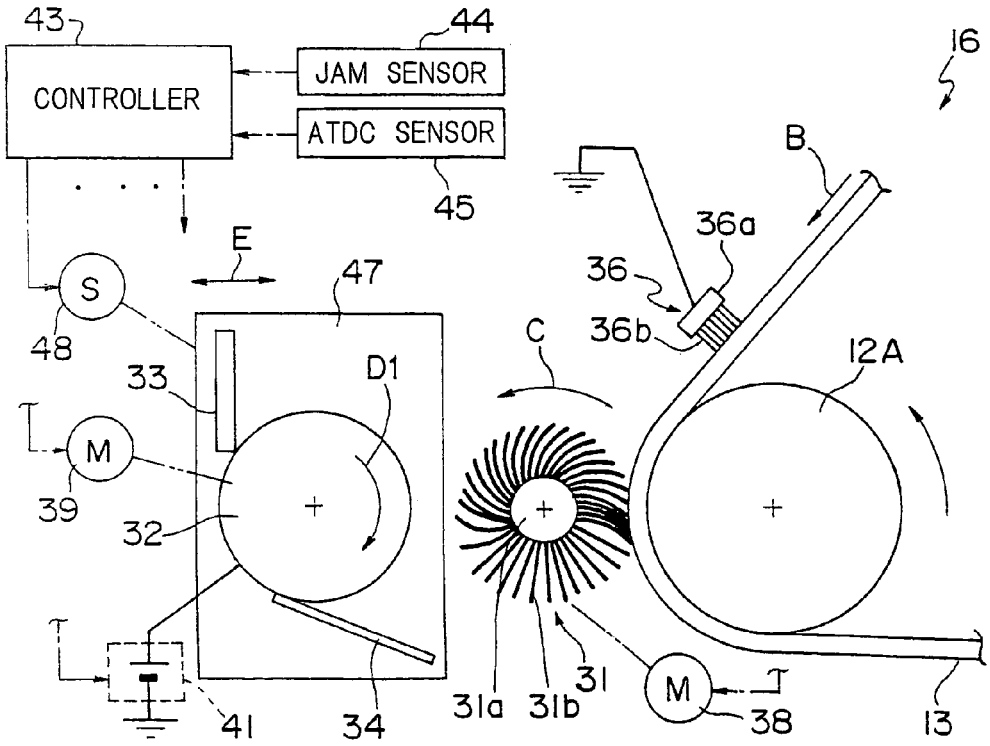
FIG. 12B is a schematic diagram showing the cleaning device according to the second embodiment of the present invention (where the collection roller is spaced to the cleaning brush)

Described below is second embodiment of the invention shown in FIGS. 12A and 12B. A collection roller 32, a scraper 33, and a seal member 34 are supported on a common a support member 47. The support member 47 can move reciprocally as indicated by an arrow E in the horizontal direction of the figure by a drive mechanism 48 provided with a solenoid and a transmission mechanism. Thus, the collection roller 32 can move between a first position where the collection roller 32 is in contact with the cleaning brush 31 as shown in FIG. 12A and a second position where the collection roller is spaced to the cleaning brush 31 as shown in FIG. 12B. In the present embodiment, a plunger of the solenoid the drive mechanism 48 is located at a retracted position when the power is off state. At this time, the support member 47 is located at such a position that the collection roller 32 is spaced to the cleaning brush 31 as shown in FIG. 12B. On the contrary, when the power is on state, the plunger is located at a protruded position. At this time, the support member 47 is located at such a position that the collection roller 32 is in contact with the cleaning brush 31 as shown in FIG. 12A.

Figure 13:
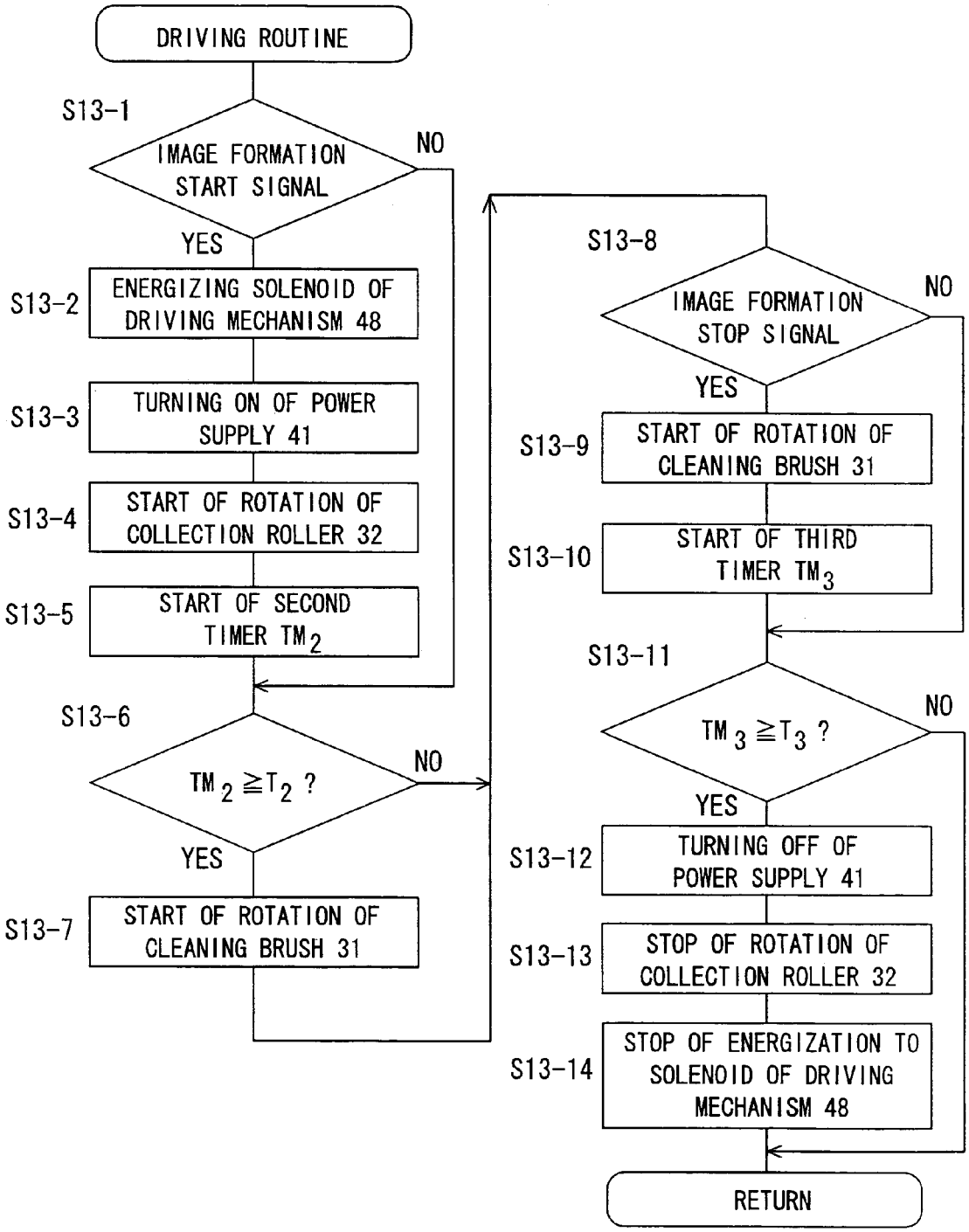
FIG. 13 is a flowchart showing a drive routine according to the second embodiment of the invention.

In the operation of second embodiment, the drive routine (step S8-3 of FIG. 8) is changed from that of first embodiment. Referring to FIG. 13, if an image generation start signal is inputted in step S13-1, the solenoid of the drive mechanism 48 is turned on in step S13-2. As a result, the plunger moves to the protruded position, so that the collection roller 32 moves from the position where it is spaced to the cleaning brush 31 as shown in FIG. 12B to the position where it is in contact with the cleaning brush 31 as shown in FIG. 12A. Then, the power supply 41 is turned on in step S13-3. Further, in step S13-4, the drive mechanism 39 starts up, so that the collection roller 32 starts rotating. In step S13-5, the second timer $TM_2$ begins time counting. In step S13-6, if the second timer $TM_2$ reaches the time length $T_2$, the drive mechanism 38 starts up in step S13-7, so that the cleaning brush 31 starts rotating.

In step S13-8, if an image generation stop signal is inputted, then the drive mechanism 39 stops in step S13-9, resulting in that the cleaning brush 31 stops rotating. Further, in step S13-10, the third timer $TM_3$ begins time counting. In step S13-11, in case that the third timer $TM_3$ reaches the time length $T_3$, the power supply 41 goes OFF in step S13-12. In step S13-13, the drive mechanism 39 stops, resulting in that the collection roller 32 stops rotating. Further, the solenoid of the drive mechanism 48 is turned off in step S13-14. As a result, the plunger moves to the retracted position, so that the collection roller 32 moves from the position where it is in contact with the cleaning brush 31 as shown in FIG. 12A to the position where it is spaced to the cleaning brush 31 as shown in FIG. 12B.

In the present embodiment, during the stop of cleaning operation, the collection roller 32 is maintained at the position where it is spaced to the cleaning brush 31. Then, at the start of cleaning operation, the collection roller 32 moves to the position where it is in contact with the cleaning brush 31 (step S13-2). Further, on completion of the cleaning operation, the collection roller 32 moves to the position where it is spaced to the cleaning brush 31 (step S13-14). Thus, the time duration that the collection roller 32 is in contact with the cleaning brush 31 is reduced to a requisite minimum. This avoids permanent inclination in the brush fibers 31*b* of the cleaning brush 31 which could occur if the cleaning brush were maintained in contact with the collection roller 32 for a long time. Other configuration and effects of second embodiment are the same as those of first embodiment.

Third Embodiment

Figure 14A:
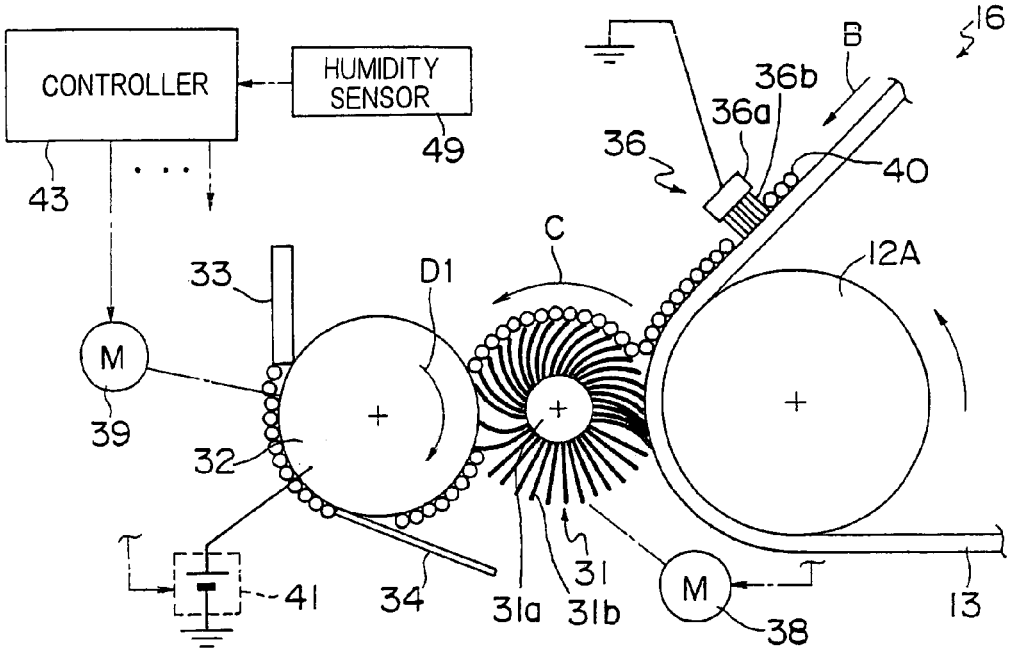
FIG. 14A is a schematic diagram showing a cleaning device according to third embodiment of the present invention (where a collection roller rotates in a forward direction)
Figure 14B:
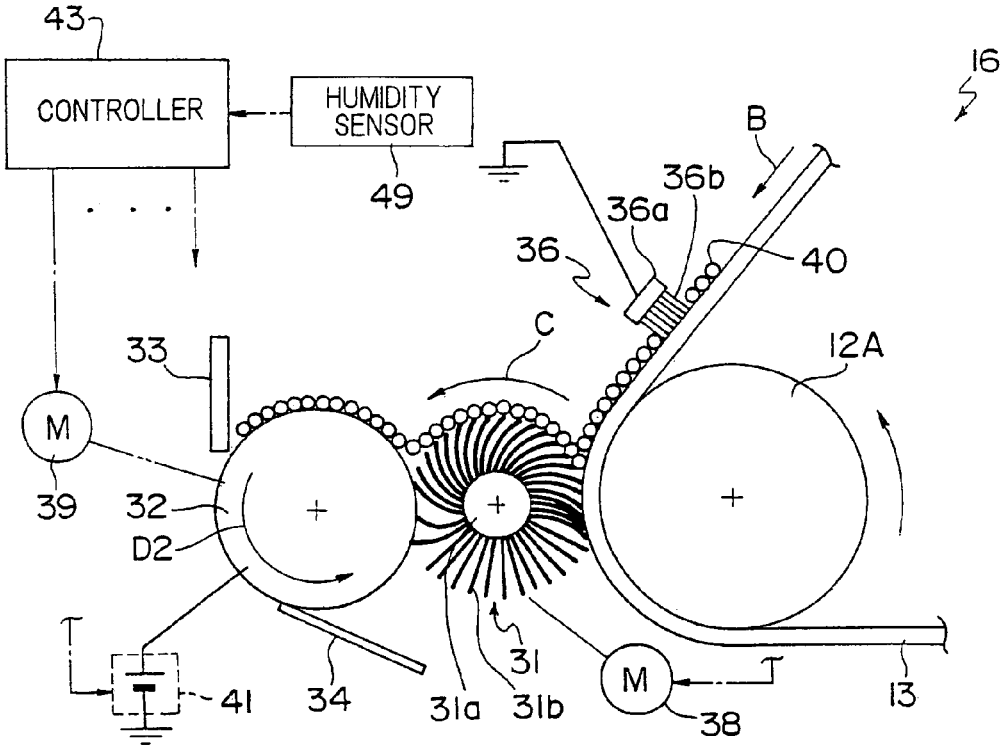
FIG. 14B is a schematic diagram showing the cleaning device according to third embodiment of the present invention (where a collection roller rotates in a reverse direction)

Described below is third embodiment of the invention shown in FIGS. 14A and 14B. In the present invention, a motor of a drive mechanism 39 can rotate two ways in the forward and the reverse directions. Thus, the collection roller 32 can rotate not only in the forward direction (arrow D1) relative to the cleaning brush 31 as shown in FIG. 14A, but also in the reverse direction (arrow D2) relative to the cleaning brush 31 as shown in FIG. 14B. The controller 43 controls the drive mechanism 39 to set the rotational direction of the collection roller 32. Further, a humidity sensor 49 for detecting the humidity inside the laser printer 11 is provided in the laser printer 11.

Referring to FIG. 6, when the circumferential speed ratio $PV_1/PV_2$ of the collection roller 32 with respect to the cleaning brush 31 is the same, a higher collection performance for the toner is obtained in the case that the collection roller 32 rotates in the reverse direction relative to the cleaning brush 31 as indicated by a solid line than in the case that the collection roller 32 rotates in the forward direction relative to the cleaning brush 31 as indicated by a broken line. On the other hand, in view of the prevention of permanent inclination in the brush fibers 31*b* of the cleaning brush 31, the rotation collection roller 32 in the forward direction relative to the cleaning brush 31 is preferred to that in the reverse direction. Thus, in the present embodiment, the collection roller 32 rotates in the reverse direction only when a higher collection performance is necessary.

During the stabilization process routine (step S7-3 of FIG. 7), a stabilization process flag $FL_{st}$ is set at "1". On the contrary, when the stabilization process routine is not on going, the stabilization process flag $FL_{st}$ is set at "0". Further, when the image processing routine (step S7-5 of FIG. 7) is on going and the image under the image generation is a color image, a color mode flag $FL_c$ is set at "1". On the contrary, when the image processing routine is not on going, or when the image processing routine is on going but the image under the image generation is a monochromatic image, the color mode flag $FL_c$ is set at "0".

Figure 15:
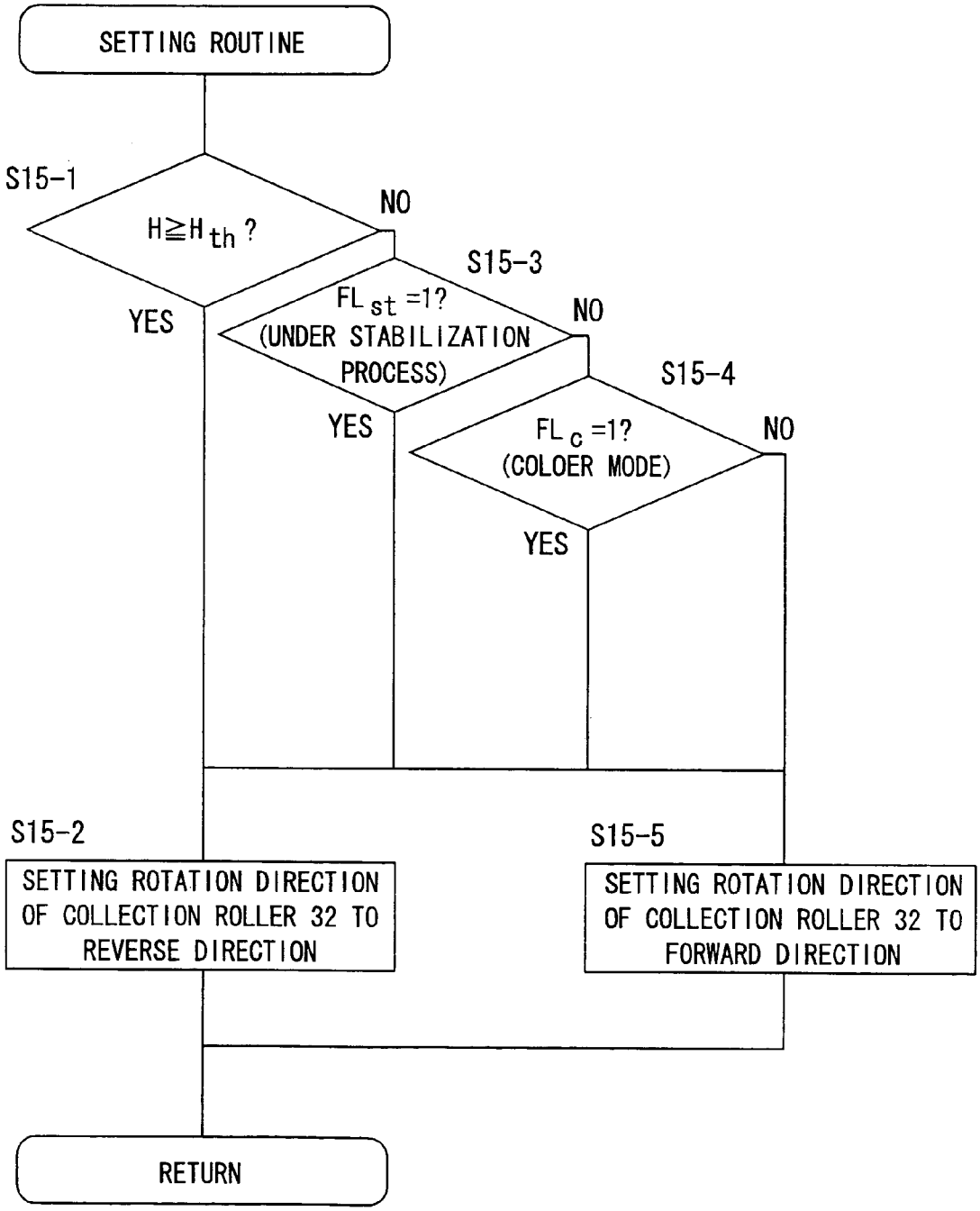
FIG. 15 is a flowchart showing a setting routine of the third embodiment of the invention.

In third embodiment, the setting routine (step S8-2 of FIG. 8) is changed from that of first embodiment. Referring to FIG. 15, in step S15-1, if the humidity H detected by the humidity sensor 49 is equal to or higher than a predetermined threshold humidity $H_{th}$, then the rotational direction of the collection roller 32 is set to the reverse direction in step S15-1. On the contrary, in step S15-1, if the humidity H detected by the humidity sensor 49 is below the predetermined threshold humidity $H_{th}$, then it is determined in step S15-3 whether the stabilization process flag $FL_{st}$ is "1" or not, that is, whether the stabilization process routine is on going or not. In step S15-3, if the stabilization process flag $FL_{st}$ is "1", then the rotational direction of the collection roller 32 is set to the reverse direction in step S15-2. On the contrary, in step S15-3, if the stabilization process flag $FL_{st}$ is not "1", then it is determined in step S15-4 whether the color mode flag $FL_c$ is "1" or not, that is, whether a color image is under image generation or not. In step S15-4, if the color mode flag $FL_c$ is "1", then the rotational direction of the collection roller 32 is set to the reverse direction in step S15-2. In step S15-4, if the color mode flag $FL_c$ is not "1", that is, if the detected humidity H is below the threshold humidity $H_{th}$ and that neither the stabilization process nor the color image generation is on going, then the rotational direction of the collection roller 32 is set to the forward direction in step S15-5.

In case that the recording medium 24 is composed of paper, the recording medium 24 absorbs moisture under a high humidity condition. This reduces the transfer efficiency in the secondary transfer device 15. Thus, the secondary transfer voltage (having the reverse polarity to the normal charging polarity of the toner 40 on the transfer belt 13) needs to be set higher under the high humidity condition. Thus, an increasing amount of toner 40 is charged into the polarity reverse to the normal charging polarity. Thus, when the humidity H detected by the humidity sensor 49 is equal to or higher than the threshold humidity $H_{th}$, the rotational direction of the collection roller 32 is reversed, so that the collection performance is increased. This achieves efficient removal of the toner 40 on the transfer belt 13 including the toner 40 changed in the reverse polarity. Further, during the stabilization process, a larger amount of toner is carried on the transfer belt 13 than during the normal image generation. Furthermore, during the color image generation, a larger amount of toner is carried on the intermediate transfer belt 13 than during the monochromatic image generation. Thus, owing to that the rotational direction of the collection roller 32 is reversed in these cases to increase the collection performance, the toner 40 on the transfer belt 13 including the toner 40 changed in the reverse polarity is removed efficiently.

Referring to FIG. 6, even in case that the collection roller 32 rotates in the forward direction, collection performance for the toner can be improved by increasing the the circumferential speed ratio $PV_1/PV_2$ of the collection roller 32 to the cleaning brush 31. Accordingly, the rotation rate of the collection roller 32 may be increased in place of reversing the rotational direction of the collection roller 32. More specifically, such a procedure may be used that in step S15-2, the direction of revolution of the collection roller 32 is set forward while the rotation rate is set at the high rotation rate $R_h$, and that in step S15-5, the rotational direction of the collection roller 32 is set forward while the rotation rate is set at the standard rotation rate $R_s$. Other configurations and operations of third embodiment are the same as those of first embodiment.

Fourth Embodiment

Described below is fourth embodiment of the present invention shown in FIGS. 16A and 16B. In the present embodiment, a cleaning device 16 is provided with an additional scraper 51 and an additional seal member 52 in addition to the scraper 33 and the seal member 34. Each of the scrapers 33 and 51 can move between a position where its tip is in contact with the collection roller 32 and a position where its tip is spaced to the collection roller 32, by drive mechanisms 56 and 57 each comprising a solenoid. Similarly, each of the seal members 34 and 52 can move between a position where it is in contact with the collection roller 32 and a position where it is spaced to the collection roller 32, by drive mechanisms 58 and 59 each comprising a solenoid.

Figure 16A:
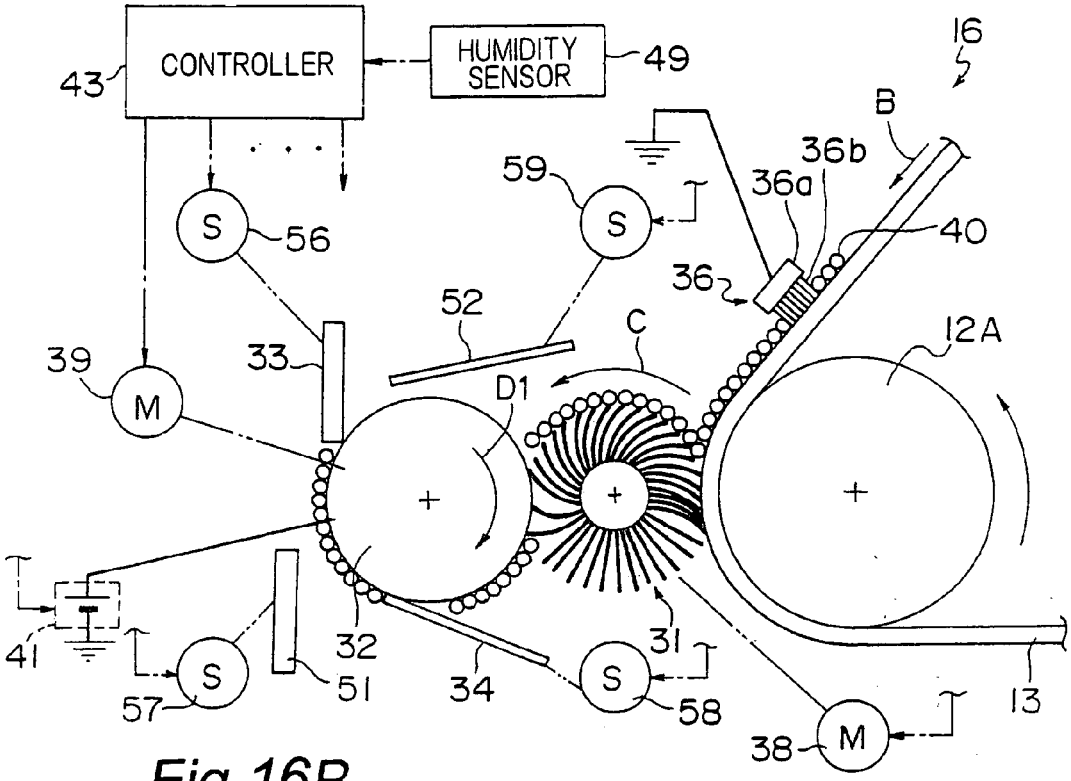
FIG. 16A is a schematic diagram showing a cleaning device according to fourth embodiment of the invention (where a collection roller rotates in the forward direction)
Figure 16B:
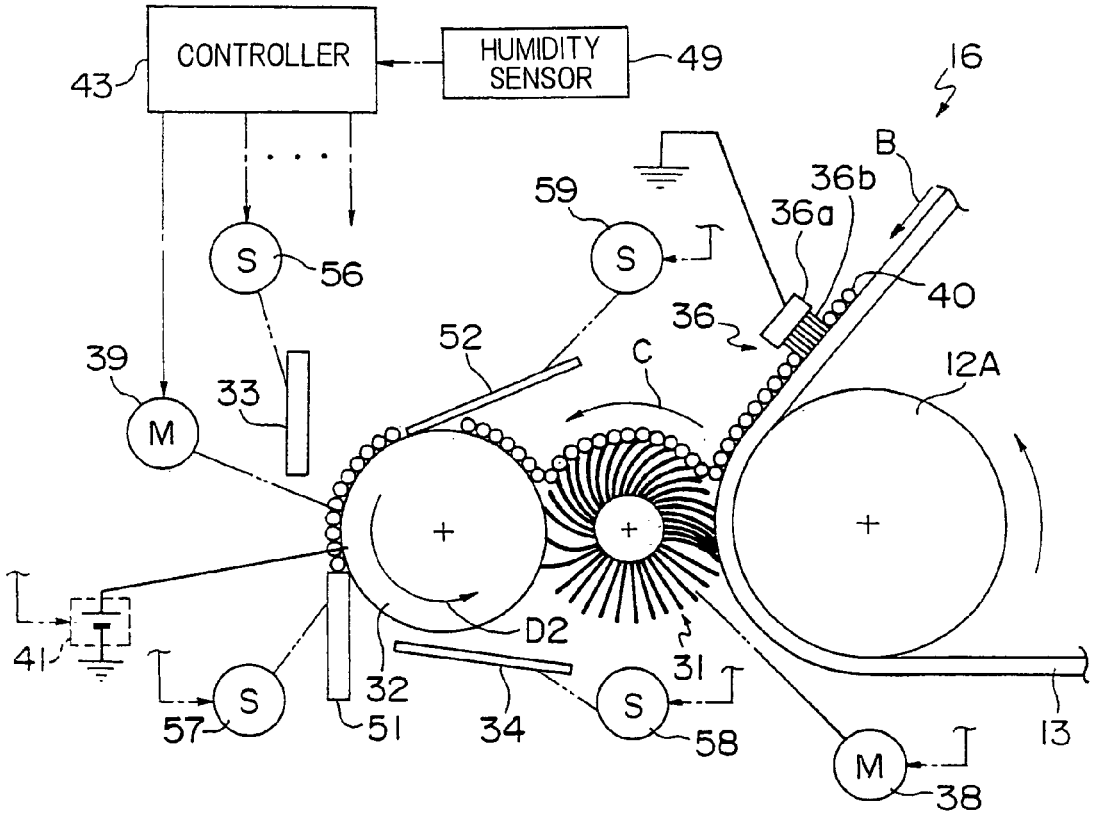
FIG. 16B is a schematic diagram showing the cleaning device according to fourth embodiment of the invention (where a collection roller rotates in the reverse direction)

As shown in FIG. 16A, when the collection roller 32 rotates in the forward direction, the scraper 33 and the seal member 34 are in contact with the collection roller 32, while the scraper 51 and the seal member 52 are spaced to the collection roller 32. On the contrary, as shown in FIG. 16B, when the collection roller 32 rotates in the reverse direction, the scraper 51 and the seal member 52 are in contact with the collection roller 32, while the scraper 33 and the seal member 34 are spaced to the collection roller 32. Each of plungers of the solenoids in the drive mechanism 56 for the scraper 33 and in the drive mechanism 58 for the seal member 34 is located at a protruded position when the solenoids are not energized and at a retracted position when the solenoids are energized. As a result, when the drive mechanisms 56 and 58 are off state, the scraper 33 and the seal member 34 are in contact with the collection roller 32. On the contrary, when the drive mechanisms 56 and 58 are on state, the scraper 33 and the seal member 34 are spaced to the collection roller 32. On the other hand, each of plungers of the solenoids in the drive mechanism 57 for the scraper 51 and in the drive mechanism 59 for the seal member 52 is located at a retracted position when the solenoids are not energized and at a protruded position when they are energized. As a result, when the drive mechanisms 57 and 59 are off state, the scraper 51 and the seal member 52 are space to the collection roller 32. On the contrary, when the drive mechanisms 57 and 59 are on state, the scraper 51 and the seal member 52 are in contact with the collection roller 32.

Figure 17:
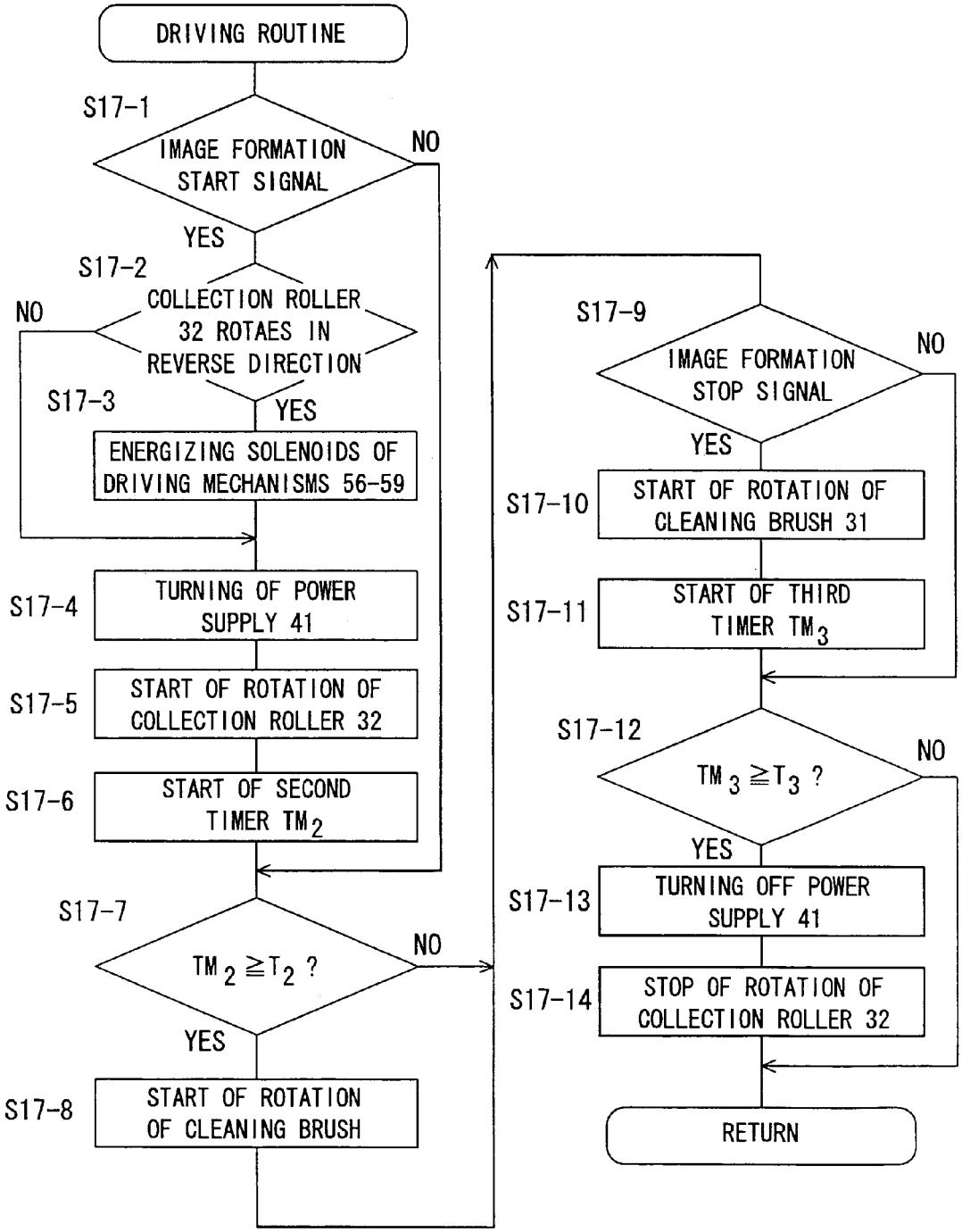
FIG. 17 is a flowchart showing a drive routine according to fourth embodiment of the invention.
Figure 18:
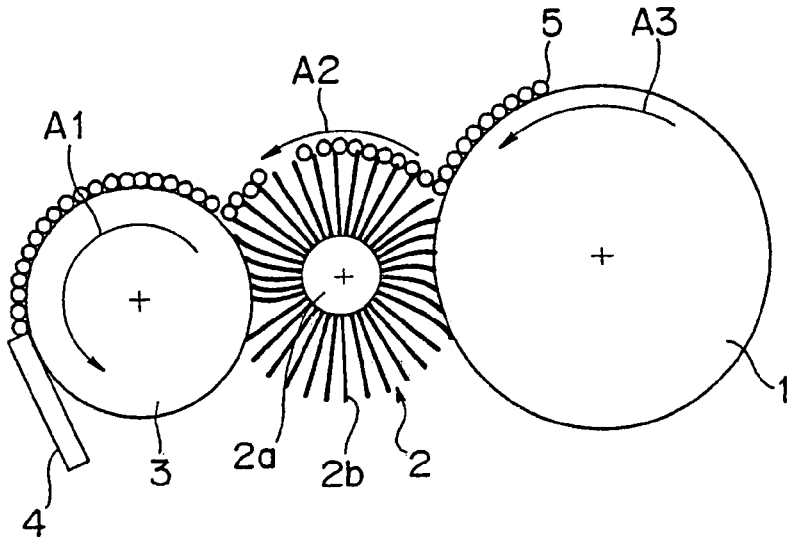
FIG. 18 is a schematic diagram showing an example of a conventional cleaning device.
Figure 19:
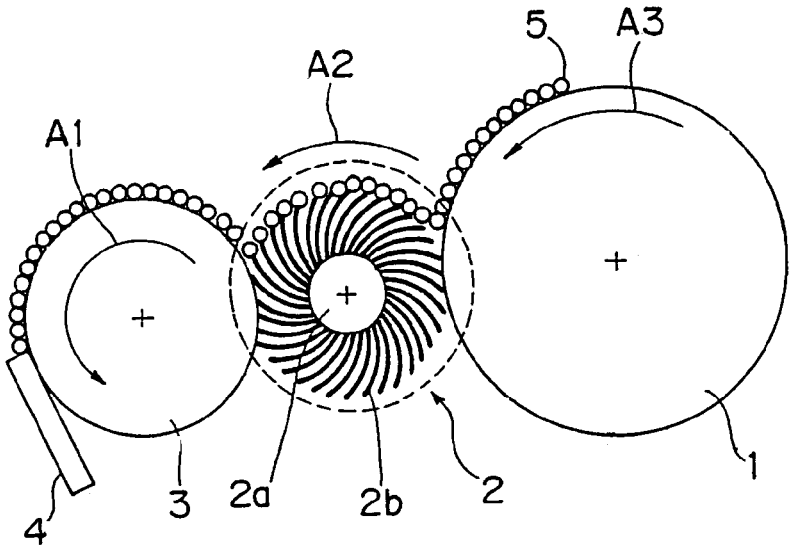
PRIOR ART Fig.19
FIG. 19 is a schematic diagram showing reduction in the outer diameter of a cleaning brush.
Figure 20:
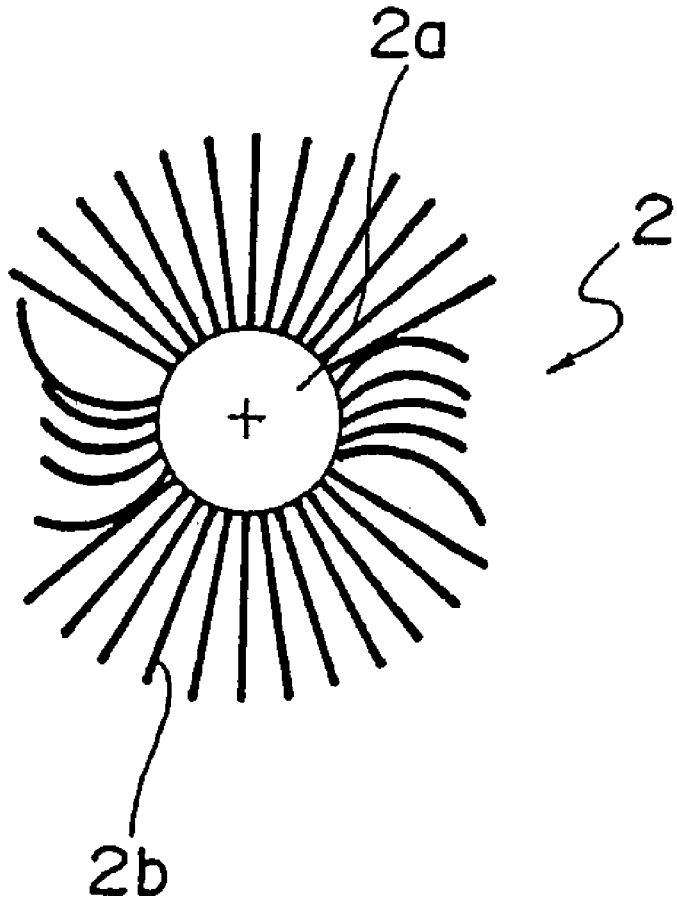
FIG. 20 is a schematic diagram showing a cleaning brush with brush fibers permanently curled.
Figure 21:
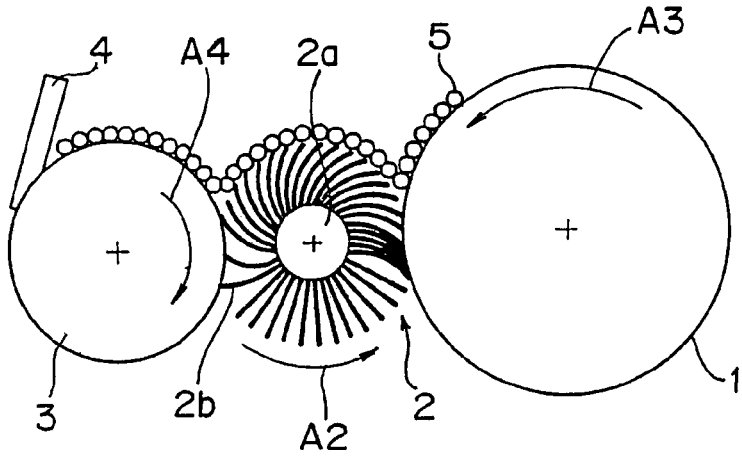
FIG. 21 is a schematic diagram showing another example of a conventional cleaning device.
Figure 22:
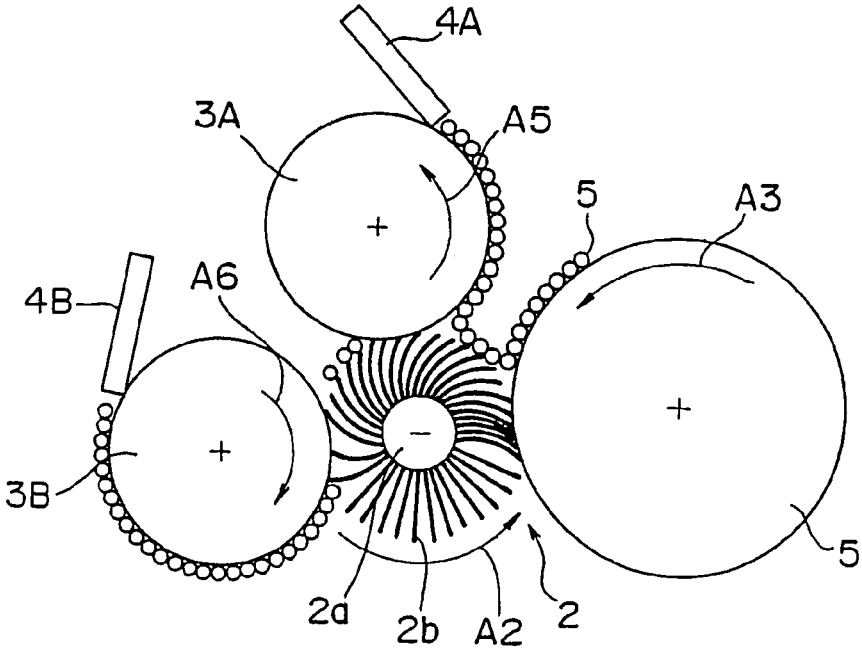
PRIOR ART Fig.22
FIG. 22 is a schematic diagram showing yet another example of a conventional cleaning device.

In the operation of fourth embodiment, the drive routine (step S8-3 of FIG. 8) solely is changed from that of third embodiment. That is, in the setting routine (FIG. 15), in the case that the humidity H is equal to higher than the threshold humidity $H_{th}$, in the case that the stabilization process is under execution, or in the case of the color mode, the rotational direction of the collection roller 32 is set to the reverse direction (step S15-2 of FIG. 15). Otherwise, the rotational direction of the collection roller 32 is set to the forward direction (step S15-5). Referring to FIG. 17, in step S17-1, if the image generation start signal is outputted, then it is determined in step S17-2 whether or not the rotational direction of the collection roller 32 has been set to the reverse direction by the setting routine. In step S17-2, if the direction of revolution of the collection roller 32 has been set to the reverse direction, the drive mechanisms 56-59 are turned on in step S17-3. As a result, as shown in FIG. 16B, the scraper 51 and the seal member 52 are in contact with the collection roller 32, while the scraper 33 and the seal member 34 are spaced to the collection roller 32. On the contrary, in step S17-2, if the direction of revolution of the collection roller 32 has been set to the forward direction, the drive mechanisms 56-59 are not turned on. As a result, as shown in FIG. 16A, the scraper 33 and the seal member 34 are in contact with the collection roller 32, while the scraper 51 and the seal member 52 are spaced to the collection roller 32. The processes of steps S17-8 through S17-14 are the same as those of the first embodiment (steps S10-2 through S10-12 of FIG. 10).

Either one combination of the scraper 33 and seal member 34 or other combination of the scraper 51 and seal member 52 is used selectively depending on the rotational direction of the collection roller 32. This selective usage improves efficiency of the collection of toner from the cleaning brush 31 to the collection roller 32.

The present invention is applicable to a cleaning device for an intermediate transfer drum and to a photoconductor including a photosensitive drum and photoconductor belt.

The present invention is applicable also to an image forming apparatus other than the laser printer, for example, to a copying machine, facsimile machine, and multi-function machine of these apparatuses.

Although the present invention has been fully described in conjunction with preferred embodiments thereof with reference to the accompanying drawings, various changes and modifications are possible for those skilled in the art. Therefore, such changes and modifications should be construed as included in the present invention unless they depart from the intention and scope of the invention as defined by the appended claims.

What is claimed is:

1. A cleaning device comprising:

a cleaning brush for removing toner from an image bearing body provided with a plurality of brush fibers in an outer periphery thereof, and adapted to be rotated in a state that the brush fibers are contacting with the image bearing body;

a collection roller for collecting the toner from the cleaning brush adapted to be rotated with contacting to the cleaning brush; and a controller for controlling rotational operations of the cleaning brush and the collection roller so that the collection roller rotates in such a manner that the collection roller and the cleaning brush move in the same direction with each other at a contact area between the collection roller and the cleaning brush, and so that a circumferential speed ratio of the collection roller with respect to the cleaning brush is greater than one and smaller than two.

2. A cleaning device as claimed in claim 1, further comprising a humidity sensor for detecting humidity in a region encompassing the image bearing body, wherein the controller sets a rotational speed of the collection roller at higher speed when the humidity detected by the humidity sensor is equal to or higher than a predetermined threshold humidity.

3. A cleaning device as claimed in claim 1, further comprising a humidity sensor for detecting humidity in a region encompassing the image bearing body, wherein the controller reverses a rotational direction of the collection roller when the humidity detected by the humidity sensor is equal to or higher than a predetermined threshold humidity.

4. A cleaning device as claimed in claim 1, further comprising a time counting section for counting a duration period during which a cleaning operation is stopped, wherein the controller sets a rotational speed of the collection roller at higher speed for a predetermined time period when the duration period counted by the time counting section exceeds a predetermined threshold duration period.

5. An image forming apparatus comprising a cleaning device as claimed in claim 1.

6. A cleaning device comprising:

a cleaning brush for removing toner from an image bearing body provided with a plurality of brush fibers in an outer periphery thereof, and adapted to be rotated in a state that the brush fibers are contacting with the image bearing body;

a collection roller for collecting the toner from the cleaning brush adapted to be rotated with contacting to the cleaning brush; and a controller for controlling rotational operations of the cleaning brush and the collection roller so that that the cleaning brush starts rotating after the collection roller starts rotating.

7. A cleaning device as claimed in claim 6, wherein the controller controls the rotational operations of the cleaning brush and the collection roller so that the collection roller stops rotating after the cleaning brush stops rotating.

8. A cleaning device as claimed in claim 7, wherein the controller controls the rotational operations of the cleaning brush and the collection roller so that the collection roller rotates in such a manner that the collection roller and the cleaning brush move in the same direction with each other at a contact area between the collection roller and the cleaning brush, and so that a circumferential speed ratio of the collection roller with respect to the cleaning brush is greater than one and smaller than two.

9. A cleaning device as claimed in claim 8, further comprising a time counting section for counting a duration period during which a cleaning operation is stopped, wherein the controller sets a rotational speed of the collection at higher speed for a predetermined time period when the duration period counted by the time counting section exceeds a predetermined threshold duration period.

10. An image forming apparatus comprising a cleaning device as claimed in claim 8.

11. A cleaning device as claimed in claim 6, further comprising a humidity sensor for detecting humidity in a region encompassing the image bearing body, wherein the controller sets the rotational speed of the collection roller at higher speed when the humidity detected by the humidity sensor is equal to or higher than a predetermined threshold humidity.

12. A cleaning device as claimed in claim 6, further comprising a humidity sensor for detecting humidity in a region encompassing the image bearing body, wherein the controller reverses a rotational direction of the collection roller when the humidity detected by the humidity sensor is equal to or higher than a predetermined threshold humidity.

13. A cleaning device comprising:

a cleaning brush for removing toner from an image bearing body provided with a plurality of brush fibers in an outer periphery thereof, and adapted to be rotated in a state that the brush fibers are contacting with the image bearing body;

a collection roller for collecting the toner from the cleaning brush adapted to be rotated with contacting to the cleaning brush; and a drive mechanism for moving the collection roller between a first position where the collection roller is in contact with the cleaning brush and a second position where the collection roller is spaced to the cleaning brush.

14. A cleaning device as claimed in claim 13, further comprising a controller for controlling a rotational operation of the cleaning brush and an operation of the drive mechanism so that the cleaning brush starts rotating after the collection roller moves from the second position to the first position.

15. A cleaning device as claimed in claim 14, wherein the controller controls the drive mechanism so that the collection roller moves from the first position to the second position after the cleaning brush stops rotating.

16. A cleaning device as claimed in claim 14, wherein the controller controls the rotational operations of the cleaning brush and the collection roller so that the cleaning brush starts rotating after the collection roller starts rotating.

17. A cleaning device as claimed in claim 14, wherein the controller controls the rotational operations of the cleaning brush and the collection roller so that the collection roller stops rotating after the cleaning brush stops rotating.

18. A cleaning device as claimed in claim 14, wherein the controller controls the rotational operations of the cleaning brush and the collection roller so that the collection roller rotates in such a manner that the collection roller and the cleaning brush move in the same direction with each other at a contact area between the collection roller and the cleaning brush, and so that a circumferential speed ratio of the collection roller with respect to the cleaning brush is greater than one and smaller than two.

19. A cleaning device as claimed in claim 18, further comprising a time counting section for counting a duration period during which a cleaning operation is stopped, wherein the controller sets a rotational speed of the collection at higher speed for a predetermined time period when the duration period counted by the time counting section exceeds a predetermined threshold duration period.

20. An image forming apparatus comprising a cleaning device as claimed in claim 18.

21. A cleaning device as claimed in claim 14, further comprising a humidity sensor for detecting humidity in a region encompassing the image bearing body, wherein the controller sets the rotational speed of the collection roller at a higher speed when the humidity detected by the humidity sensor is equal to or higher than a predetermined threshold humidity.

22. A cleaning device as claimed in claim 14, further comprising a humidity sensor for detecting humidity in a region encompassing the image bearing body, wherein the controller reverses the rotational direction of the collection roller when the humidity detected by the humidity sensor is equal to or higher than a predetermined threshold humidity.

* * * * *